US006158737A

United States Patent [19]

Cornell et al.

[11] Patent Number: 6,158,737

[45] Date of Patent: Dec. 12, 2000

[54] PLAYFIELD ASSEMBLY FOR A PINBALL-MACHINE

[75] Inventors: Bradley D. Cornell, Chicago; John R. Krutsch, Lake Villa; James A. Patla, Rolling Meadows, all of Ill.

[73] Assignee: Williams Electronics Games, Inc., Chicago, Ill.

[21] Appl. No.: 09/232,249

[22] Filed: Jan. 14, 1999

[51] Int. Cl.[7] ..... A63F 7/36; A47B 88/00

[52] U.S. Cl. ..... 273/118 R; 273/119 R; 273/119 A; 273/118 A

[58] Field of Search ..... 273/118–121; 312/313

[56] References Cited

U.S. PATENT DOCUMENTS

| | | |
|---|---|---|
| 2,468,452 | 4/1949 | Leverenz . |
| 2,845,618 | 7/1958 | Huffman . |
| 3,549,803 | 12/1970 | Becht et al. . |
| 3,675,927 | 7/1972 | Gottlieb et al. . |
| 4,093,347 | 6/1978 | La Russa . |
| 4,189,145 | 2/1980 | Stubben et al. . |
| 4,305,095 | 12/1981 | Dallas . |
| 4,306,768 | 12/1981 | Egging . |
| 4,367,876 | 1/1983 | Kotoyori . |
| 4,371,164 | 2/1983 | Halliburton . |
| 4,375,286 | 3/1983 | Seitz et al. . |
| 4,421,317 | 12/1983 | Hector et al. . |
| 4,448,417 | 5/1984 | Clark et al. . |
| 4,490,745 | 12/1984 | Erickson et al. . |
| 4,650,190 | 3/1987 | Geiger . |
| 4,736,214 | 4/1988 | Rogers . |
| 4,853,764 | 8/1989 | Sutter . |
| 4,865,322 | 9/1989 | Krutsch . |
| 4,936,580 | 6/1990 | Kaminkow . |
| 5,112,049 | 5/1992 | Borg . |
| 5,190,286 | 3/1993 | Watanabe et al. . |
| 5,193,807 | 3/1993 | Schilling et al. . |
| 5,221,083 | 6/1993 | Dote . |
| 5,316,303 | 5/1994 | Trudeau et al. . |
| 5,327,284 | 7/1994 | Kuester . |
| 5,351,966 | 10/1994 | Tohyama et al. . |
| 5,364,096 | 11/1994 | Cebula et al. . |
| 5,417,422 | 5/1995 | Hansen . |
| 5,418,579 | 5/1995 | Jamieson et al. . |
| 5,494,285 | 2/1996 | Coldebella et al. . |
| 5,536,082 | 7/1996 | Ritchie et al. . |
| 5,553,864 | 9/1996 | Sitrick . |
| 5,669,685 | 9/1997 | Kotani et al. . |
| 5,685,625 | 11/1997 | Beaver . |
| 5,741,010 | 4/1998 | Weyna . |

FOREIGN PATENT DOCUMENTS

| | | |
|---|---|---|
| 2 124 505 | 2/1984 | United Kingdom . |
| WO 8401908 | 5/1984 | WIPO . |

OTHER PUBLICATIONS

Safe Cracker Operations Manual, pp. 1–1 through 3–32 (in particular pp. 1–6), Williams Electronics Games, Inc., Chicago, Illinois, pp. 1–6, Apr. 1996.

Description and drawings of 10 Pin Deluxe game, Williams Electronics Games, Inc., Chicago, Illinois, date unknown.

Description and photograph of Namco redemption game, Namco, Ltd., Tokyo, Japan, date unknown.

Brochure for 10 Pin Deluxe Game, Midway Games Inc., Chicago, Illinois, date unknown.

*Primary Examiner*—Raleigh W. Chiu
*Attorney, Agent, or Firm*—Jenkins & Gilchrist

[57] ABSTRACT

A pinball machine has been designed with several novel mechanical and electrical features such that it is easily retrofittable or convertible between a first pinball game and a second pinball game. One of these features is a novel playfield assembly for the pinball machine. For ease of movement of the playfield into and from a cabinet of the pinball machine, the playfield has skid rails which extend substantially along the length of the playfield. The skid rails are spaced from the lower side of the playfield by a distance that is greater than the distance by which components protrude from the lower side of the playfield. Thus, the playfield can be placed on the ground without any chance for damage of its components. The playfield may also include a slide stop at one or both of its ends. The slide stops engage the front molding of the cabinet to ensure the playfield does not fall into the cabinet or fall from the cabinet as the skid rails are being slid across the front molding.

25 Claims, 18 Drawing Sheets

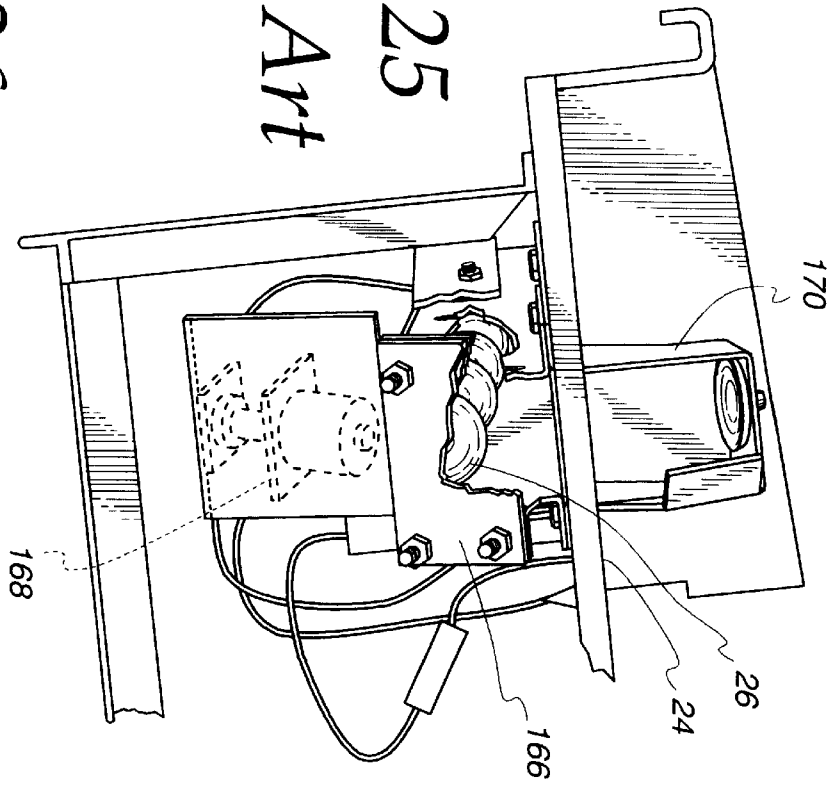
Fig. 25
Prior Art
Fig. 26
Prior Art
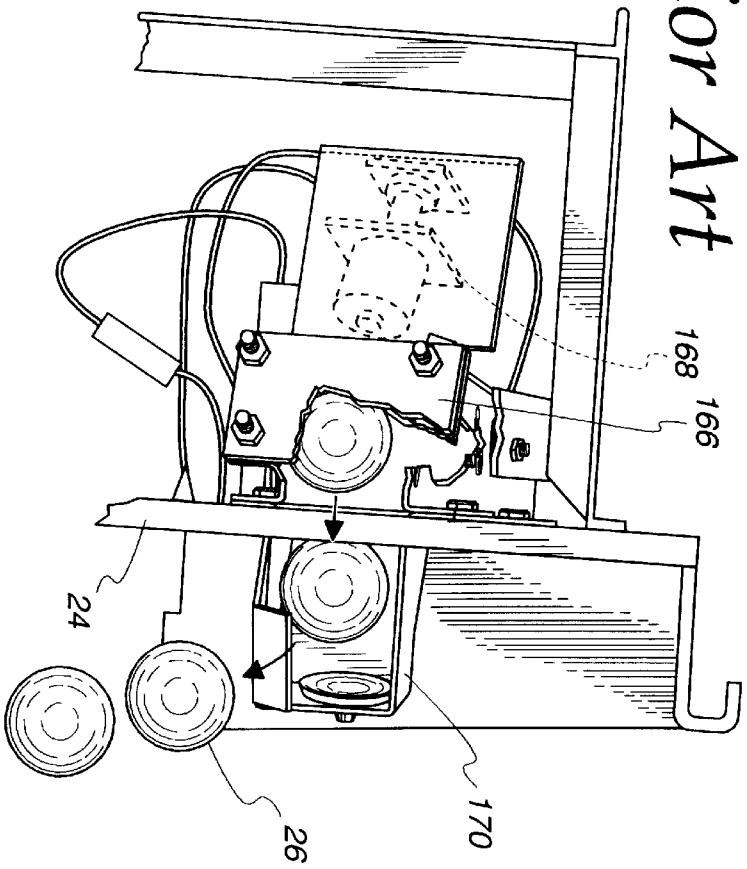

PLAYFIELD ASSEMBLY FOR A PINBALL-MACHINE

RELATED APPLICATIONS

This application is being filed concurrently with U.S. application Ser. No. 09/231,400 entitled "Method and Kit for Retrofitting a Pinball Machine", U.S. application Ser. No. 09/231,092 entitled "Lock-Down Bar Release System for a Pinball Machine", U.S. application Ser. No. 09/231,092 entitled "Game With Viewing Panel Having Variable Optical Characteristics for Producing Virtual Images", U.S. application Ser. No. 09/232,250 entitled "Electronic Component Board Mounting System", U.S. application Ser. No. 09/231,404 entitled "Mounting Mechanism for a Playfield of a Pinball Machine", U.S. application Ser. No. 09/231,403 entitled "Method of Displaying Video Images Projected from a Video Display of a Pinball Machine", U.S. application Ser. No. 09/232,251 entitled "Method of Modifying Electronics Contained in a Controller Box of a Pinball Machine", U.S. application Ser. No. 09/232,248 entitled "Method of Replacing a Playfield of a Pinball Machine", U.S. application Ser. No. 09/231,402 entitled "Ball Block Assembly for a Pinball Machine", U.S. application Ser. No. 09/232,247 entitled "Method of Identifying the Condition of a Lamp or Fuse of a Pinball Machine", all of which are herein incorporated by reference in their entireties.

FIELD OF THE INVENTION

This invention relates generally to a pinball machine, and more particularly, to a playfield assembly for a pinball machine which protects components mounted beneath a playfield of the assembly during movement of the assembly into and from a cabinet of the pinball machine.

BACKGROUND OF THE INVENTION

Pinball games are often found together in arcades, restaurants, bars, and other amusement establishments. Generally speaking, a pinball game includes a playfield that supports a rolling ball and is mounted in a generally horizontally disposed cabinet. The playfield is usually tilted or inclined at a slight angle to cause the ball to roll toward the end or bottom of the playfield. The player uses flippers at the bottom of the playfield to propel the ball back into the playfield area. A transparent structure is placed over the playfield to limit the player's interaction with the ball to only the flippers. A display for pinball games usually consists of an alphanumeric display for showing the score of one or more players. This display is usually mounted in a backbox which is mounted above the cabinet and generally at an end opposite the player position. The display may utilize electromechanical alphanumeric display elements or electrical or electronic illuminated display elements such as neon tubes or LEDs or the like. In some cases, the so-called dot matrix display have been used to generate alphanumeric displays, and other somewhat limited visual displays.

Designers of pinball games strive to constantly provide innovations to continue to attract interest, both for attracting new players and for retaining the interest of present players. While appealing new input and output features for pinball games assists in attracting new players and retaining the existing players, these new features are typically introduced to the market in the form of an entirely new pinball machine. In other words, an arcade owner has to purchase the new machine to place these new player-appeal features into his or her arcade. This introduction process usually entails removing an old machine that is out of favor and replacing it with the new machine. Thus, the cost to the arcade owner not only includes the cost of the new machine, but the costs associated with removing the old machine such as transportation, advertising it for resale, etc. In some instances, arcade owners have been provided with conversion kits that alter the physical features of an existing pinball machine. These kits may include new input/output elements on the playfield or an entirely new playfield and different artwork for the pinball machine. However, pinball machines were not designed for retrofitting which makes the conversion process difficult. And, the new pinball game is limited by the electronic capabilities that were present in the existing machine structure.

The assignee of the present application has developed a novel type of pinball machine wherein a video image is projected onto the glass covering the playfield and is reflected therefrom for viewing by the player. In this novel pinball machine, the projected video images are interactive with various input/output elements associated with the playfield. The details of this novel pinball machine are disclosed in U.S. application Ser. No. 09/081,146, filed May 19, 1998, entitled "Amusement Game With Pinball Type Playfield and Virtual Video Images," and incorporated herein by reference in its entirety.

The aforementioned novel pinball machine of the assignee not only has the benefit of providing outstanding player-appeal features through the images projected onto the playfield, but it presents the arcade owner with a new option for altering existing pinball machines. Specifically, the look and feel of the pinball machine can be significantly altered by providing new images to be viewed by the player and possibly a new playfield to accompany the new images. Thus, the arcade owner is now provided with a method by which the same pinball machine frame can be maintained in his arcade, but still constantly introduce many new player-appeal features to sustain his or her clientele.

SUMMARY OF THE INVENTION

In accordance with the present invention, a pinball machine has been designed with several novel mechanical and electrical features that facilitate conversion of the pinball machine between a first pinball game and a second pinball game. One of these features is a novel playfield assembly for the pinball machine. For ease of movement of the playfield into and from the cabinet, the playfield has skid rails which extend substantially along the length of the playfield. The skid rails are spaced from the lower side of the playfield by a distance that is greater than the distance by which components protrude from the lower side of the playfield. Thus, the playfield can be placed on the ground without any chance for damage of its components. The playfield may also include a slide stop at one or both of its ends. The slide stops engage the front molding of the cabinet to ensure the playfield does not fall into the cabinet or fall from the cabinet as the skid rails are being slid across the front molding.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which:

FIG. 25 is a magnified view of the ball trough assembly in FIG. 23;

FIG. 26 is a magnified view of the ball trough assembly in FIG. 24;

Figure 1:
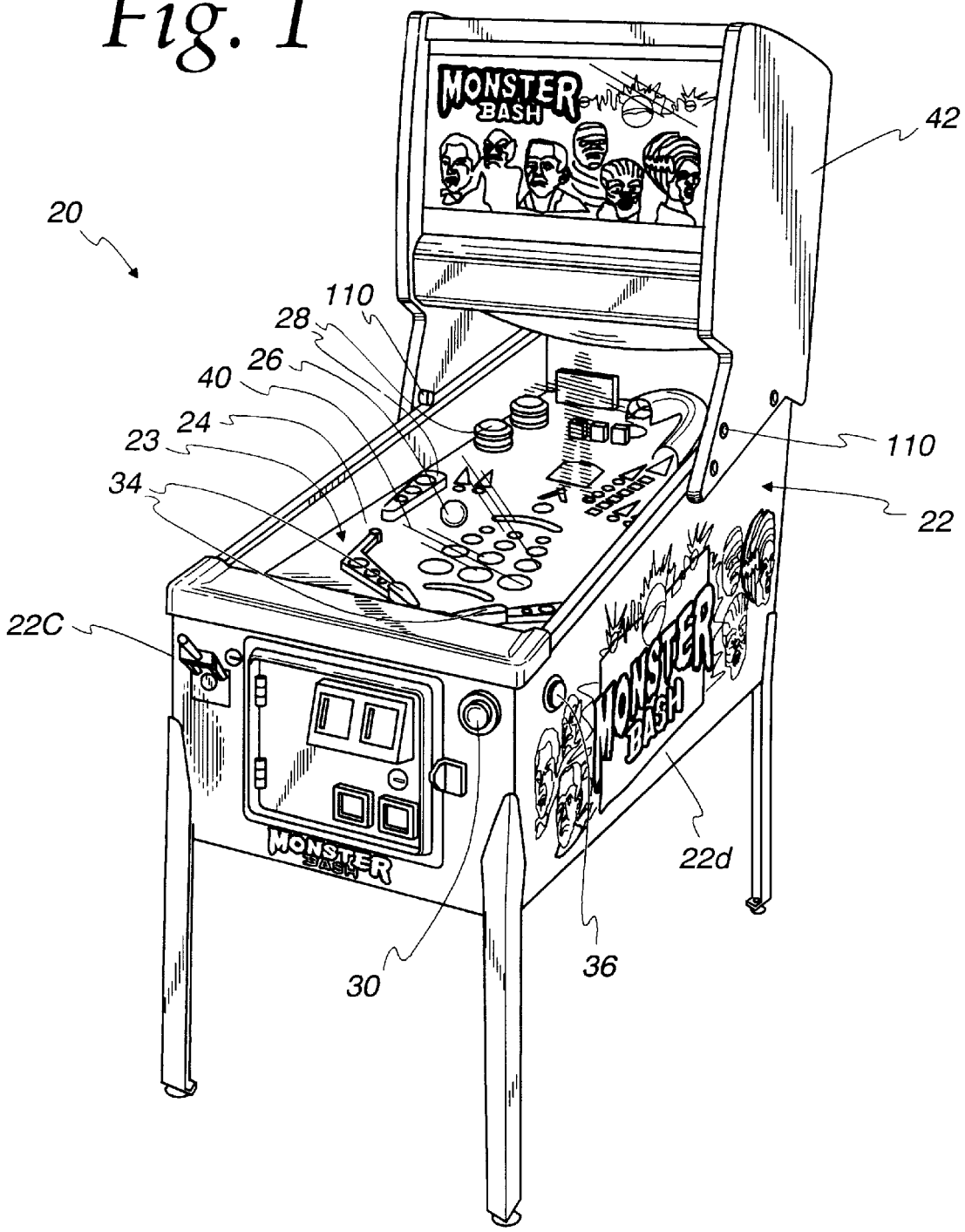
FIG. 1 is a perspective view of a pinball machine prior to being converted from a first pinball game to a second pinball game.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
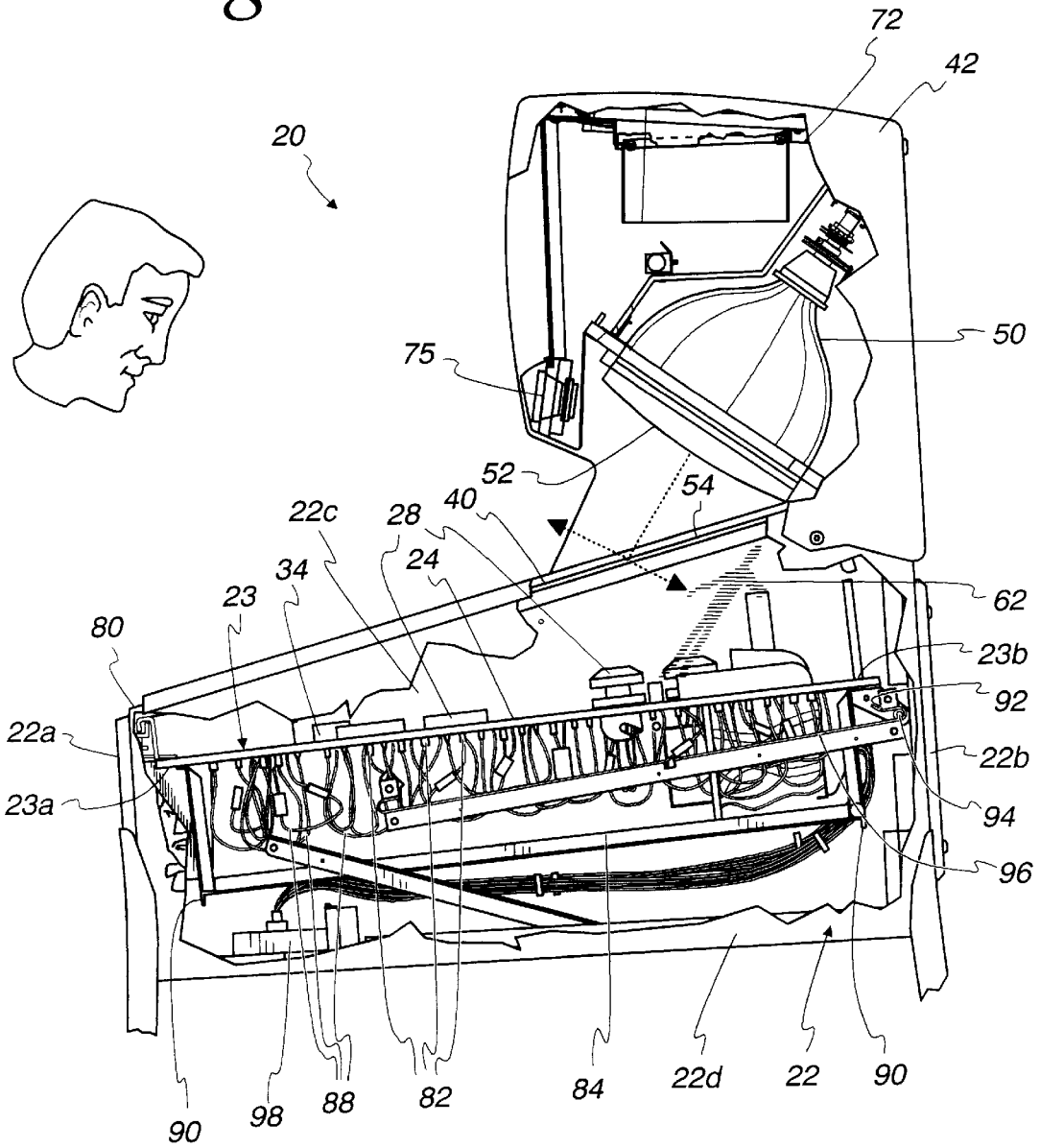
FIG. 2 is a side view of the pinball machine with portions broken away to reveal internal structure.

Referring now to the drawings, and initially to FIGS. 1 and 2, there is shown an amusement game in accordance with the present invention, and designated generally by the reference numeral 20. The amusement game 20 includes a cabinet 22 which houses a playfield assembly 23 including a playing field or playfield 24 which may be inclined. The playing field 24 supports a game piece such as a rolling ball 26 and has a plurality of playfield features and devices. These features and devices may take a number of forms and some relatively simplified play features are indicated generally by reference numeral 28. The ball 26 may be initially introduced into the playfield 24 by shooting the ball 26 with a ball propelling element such as a plunger 30. The plunger 30 may be of the manually-actuated type as shown or, alternatively, may be automatically actuated in response to depression of a shooter button mounted to the front of the cabinet.

If the playfield 24 is inclined, as shown in FIG. 2, the ball tends to roll back generally in the direction of a pair of flippers 34 located at a bottom end part of the playfield 24. The flippers 34, which are activated by buttons 36 on the sides of the cabinet, are used by the skilled player to propel the ball back into the playfield 24. The playfield devices and features 28 may include a number of elements such as bumpers as well as other elements. These other elements may include, without limitation, targets, various lights or other illumination devices, three-dimensional objects or figures, targets which are fixed or moveable, and so-called pop-up targets which are mounted generally below the surface of the playfield and may be selectively extended or retracted relative to the playfield. Other elements may also be used, such as lanes, ramps, elements which are capable of selectively holding and releasing the ball, etc. Other types of playfield features or devices might be utilized without departing from the invention, the foregoing being by way of example only.

The playfield 24 is generally covered by a transparent panel 40 of glass or plastic through which a player may view the playfield 24 and its contents. A backbox 42 is mounted generally above the playfield and usually at an end thereof opposite a player station which is adjacent the location of the flippers 34 and plunger 30. Flipper control buttons 36 are also usually provided at the sides of the cabinet 22 for controlling the operation of the flippers 34.

The above-described features are usually found in various pinball games. The novel features of the present invention will now be described in detail.

Referring to FIG. 2, the backbox 42 mounts a cathode ray tube (CRT) 50 or functionally equivalent structure such as one or more rows or a grid of LED's, or a flat screen video display device, or a video projector. The CRT 50 is mounted such that its screen 52 is directed generally in the direction of the playfield 24, that is, generally in the vertically downward orientation as indicated in FIG. 2. Cooperatively, a portion 54 of the transparent panel 40 which is aligned with the image surface or screen 52 of the CRT 50 thereabove is constructed of material that has both transparent and reflective properties. For example, the panel portion 54 may be constructed of tinted glass or plastic. Advantageously, the relative orientations or angular offsets of the CRT screen 52 and the panel 54 are such that an image appearing on the screen 52 will be projected as a virtual image 62 into the cabinet 22 in association with the playfield 24. In the illustrated embodiment, these relative angles and positions of the CRT screen 52 and the panel 54 are such that the virtual image appears to be projecting in a generally vertical direction intersecting with or projecting out of the playfield 24 as indicated in FIGS. 1 and 2. By changing the position of the CRT 50, the position of the virtual image may be moved back and forth relative to the playfield. It will be appreciated that the angular orientation of the virtual image 62 relative to the playfield 24 may also be varied as desired by varying the angle of the CRT or other device. The same considerations of spacing, angles and relative positions apply, in order to obtain a virtual image at a desired position, where the image is provided by apparatus other than or in addition to a CRT, such as a video projector, rows or grids of LED's, etc.

The image 62 projected into the playfield 24 may be a two dimensional image or a three-dimensional image, if desired, such that the virtual image 62 may have components which appear to be in a single plane intersecting the playfield or which appear to be in any number of positions behind the plane of the image 62 shown in FIGS. 1 and 2. Additional images in other positions, including in front of this plane, could be provided by a second image producing apparatus (such as a second CRT, a row or grid of LED's, a flat screen device, or a video projector) mounted adjacent the CRT 50, and located relative to the surface 54 to produce the added or second image at the desired location. Moreover, the virtual image 62 may include a virtual image of a game piece or ball. In the same manner, the virtual image 62 may include a playfield or playfield features.

The virtual image 62 projected into the playfield from the CRT 50 may include fixed or moving images, video displays, scoring and/or instructional displays, or a combination of such images and displays, as desired. A source of data or information for forming these images on the CRT screen 52 may be electronics 70 (see FIG. 12) mounted in the backbox 42. The electronics 70 include a computer, processor, or other controller and one or more associated storage devices or sources from which the controller may select images (and audio effects information, if desired) for display (or reproduction). A cable 72 couples the controller 70 to the CRT 50. In connection with the controller 70, various storage devices or other sources of images (and, if desired, corresponding audio information) may be used including, but not limited to, ROM, RAM and other forms of solid state memory devices, either as a part of, or operatively coupled with the controller 70, as well as magnetic disk, optical disk, video disk, video tape, and the like and corresponding player units operatively coupled with the controller 70. The images may also be imported from other sources by use of a modem or other means operatively connected with the controller 70, such as broadcast TV or satellite TV tuners, a cable TV hookup, or a proprietary cable feed, among other things. Any other source of video image information (and, if desired, corresponding audio information) might be utilized without departing from the invention. An audio or sound reproduction device such as a loudspeaker 75 may be provided for reproducing any desired audio effects.

In accordance with the present invention, there is provided a method of retrofitting/converting the pinball machine 20 from one model to a different model. To convert the pinball machine 20, there is provided a conversion kit that generally contains the following components: a replacement playfield assembly 23' (see FIGS. 14–18), a replacement backbox panel (i.e., "backglass") or decorative sheet, decals 154 (see FIG. 18) for the cabinet 22 and backbox 42, and possibly replacement memories (e.g. ROMs) storing a new game program, video images, and sounds. The pinball machine 20 includes numerous features for facilitating its conversion from one model to a different model. These features are described below in the context of the conversion method, which is illustrated in FIGS. 3 through 18.

The first step in the conversion method is to turn off the pinball machine's power switch and unplug the machine's electrical cord from any power outlet to which it is connected.

Figure 3:
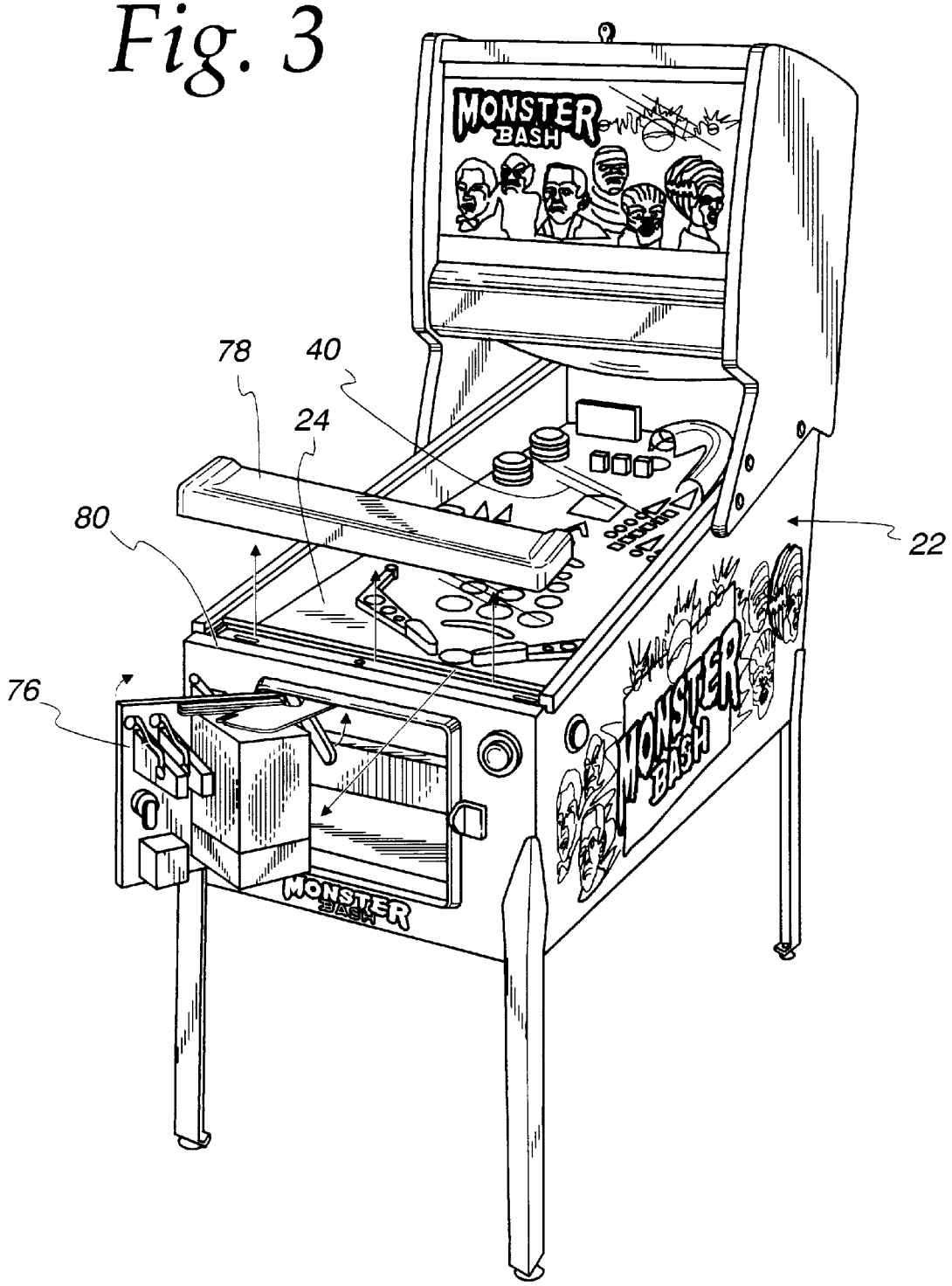
FIG. 3 is a perspective view of the pinball machine with a coin door opened and a handguard disengaged from a front molding of a game cabinet.

Next, referring to FIG. 3, a coin door 76 hingedly mounted to a front of the cabinet 22 is unlocked and opened. A handguard 78 (also known as a lock-down bar) is disengaged and removed from the front molding 80 of the cabinet 22. The front molding 80 is intended to refer to the top front portion of the cabinet 22. Further details concerning the structure and operation of the handguard 78 may be obtained from U.S. patent application Ser. No. 09/231,092 entitled "Lock-Down Bar Release System for a Pinball Machine", filed concurrently herewith, and incorporated herein by reference in its entirety.

Still referring to FIG. 3, after removing the handguard 78, the glass panel 40 overlaying the playfield 24 is slid off the front of the cabinet 22. The glass panel 40 is slidably mounted to the cabinet 22 and is secured in its place overlaying the playfield 24 by the handguard 78. Removal of the handguard 78 allows the glass panel 40 to in turn be removed from the cabinet 22.

Figure 4:
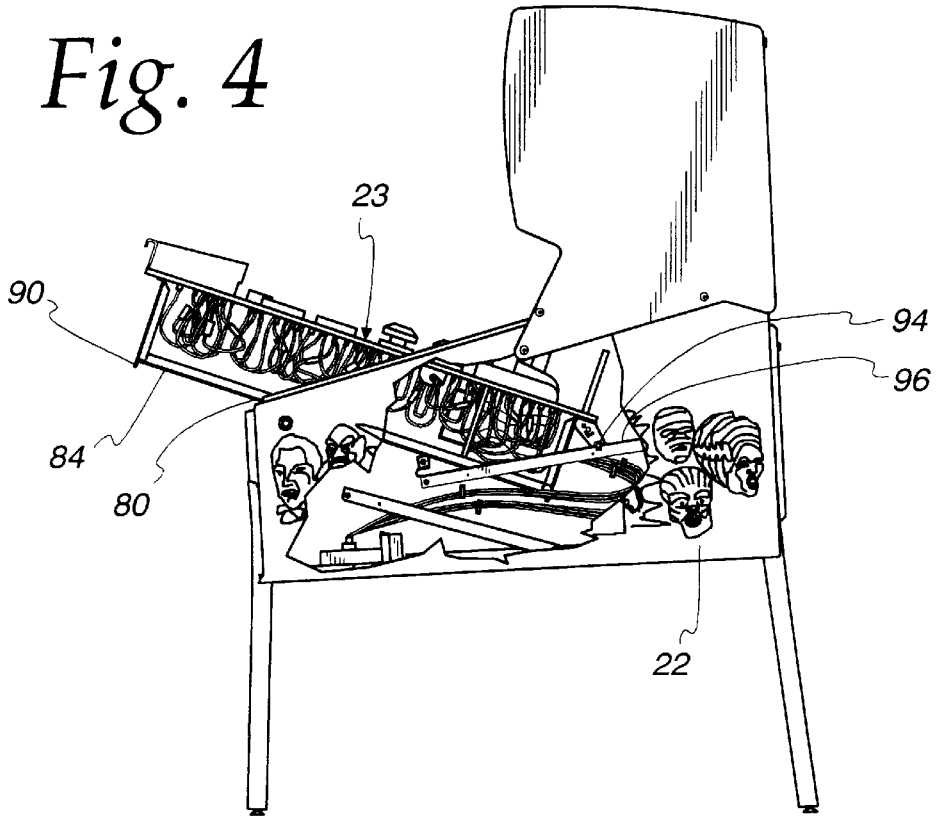
FIGS. 4 and 5 are side views of the pinball machine with portions broken away to reveal internal structure and showing a playfield assembly being removed from the cabinet.
Figure 5:
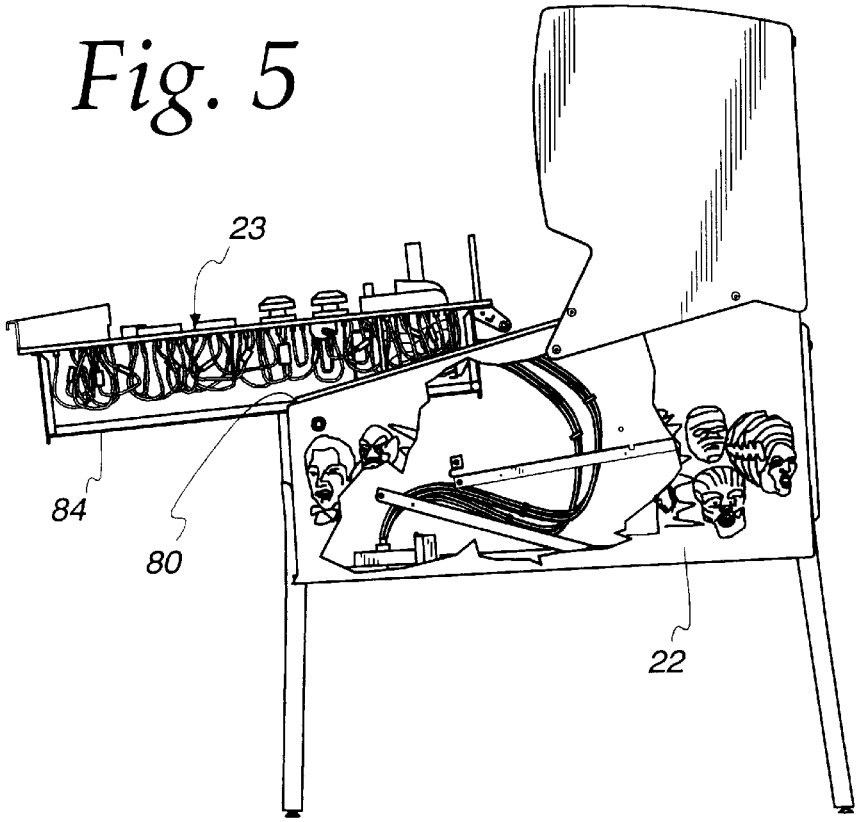
Figure 6:
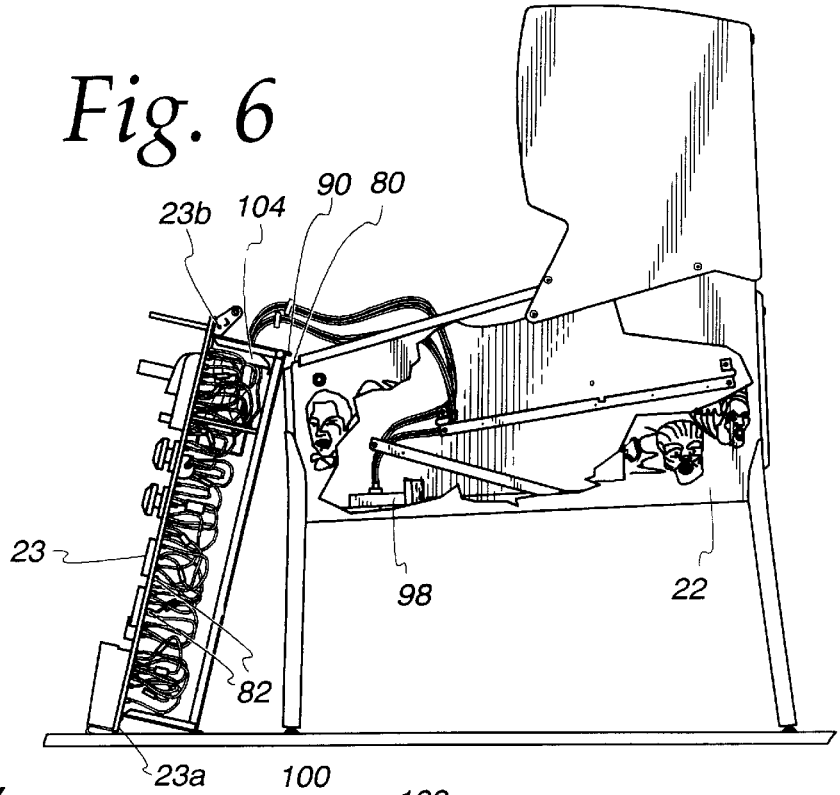
FIG. 6 is a side view of the pinball machine with portions broken away to reveal internal structure and showing the playfield assembly entirely removed from the cabinet.

Referring to FIGS. 4–6, the playfield assembly 23 is removed from the cabinet 22. This action is facilitated by the structure of the playfield assembly 23 and the manner in which it is mounted within the cabinet 22.

As shown in FIG. 2, the playfield assembly 23 includes opposing proximal and distal ends 23*a* and 23*b* separated by a distance L. When the playfield assembly 23 is disposed within the cabinet 22, the proximal and distal ends 23*a* and 23*b* of the playfield assembly 23 are adjacent to the respective front and rear ends 22*a* and 22*b* of the cabinet 22. The playfield assembly 23 includes the playfield 24, a plurality of input/output elements 82, and a pair of skid rails 84 (only one shown in FIG. 2) which are typically metallic or a rigid plastic. The input/output elements 82, including but not limited to lamps, solenoids, and switches, are mounted to the playfield 24 and are electronically connected to a plurality of rigid electrical connectors 86 (see FIG. 7) by electrical wires 88. The electrical wires 88 are sufficiently short in length and secured to an underside of the playfield 24 such that the connectors 86 (see FIG. 7), wires 88, and input/output elements 82 are limited in movement to a region generally beneath and in close proximity to the playfield 24.

The skid rails 84 are mounted to the underside of the playfield 24 and preferably extend substantially along the length L of the playfield assembly 23. If the portions of the input/output elements 82 on the underside of the playfield 24, such as their electrical connectors 86, are spaced from the underside of the playfield 24 by a maximum distance D, then the skid rails 84 are spaced from the underside of the playfield 24 by a distance greater than or equal to the distance D. A pair of opposing rigid slide stops 90 are generally perpendicular to and project downward from each skid rail 84. The pair of slide stops 90 may be attached to opposite ends of the respective skid rail 84 as shown or, alternatively, may be separate members attached to the lower side of the playfield 24 and projecting downward therefrom beyond the respective skid rail 84. While a pair of slide stops 90 are preferably associated with each skid rail 84, there may alternatively be just a single pair of slide stops 90 at opposite ends of the playfield assembly 23. The slide stops 90 are usually metallic or a rigid plastic. During removal and installation of the playfield assembly 23, the slide stops 90 are used to engage the front molding 80 of the cabinet 22 which is exposed upon removal of the handguard 78 (see FIG. 3).

Figure 20:
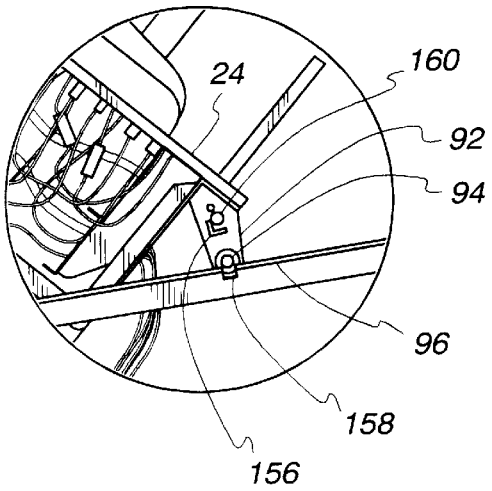
FIG. 20 is a magnified view of a circled region in FIG. 19.

Referring to FIGS. 2 and 20, to allow the playfield assembly 23 to be mounted to the cabinet 22, the playfield assembly 23 includes a bracket 92 mounted to a distal end of the playfield 24 and, preferably, one bracket 92 on each side of the playfield 24. Each bracket 92 includes a pivot pin 94 protruding laterally away from the playfield 24. A slide rail 96 is attached to the inner surface of each of the opposing sides 22*c* and 22*d* (see FIG. 1) of the cabinet 22. The pivot pin 94 is adapted to slide along the respective slide rail 96.

To remove the playfield assembly 23 from the cabinet 22, an operator performs the steps illustrated in FIGS. 4–6. First, the playfield assembly 23 is angled upward and pulled forward until the front portion of the skid rails 84 rest on the front molding 80 of the cabinet 22 as shown in FIG. 4. The pivot pin 94 slides along the respective slide rail 96 as the playfield assembly 23 is pulled forward. The front slide stops 90 are adapted to engage or "catch" on the front molding 80 to prevent the playfield assembly 23 from accidentally sliding back and dropping into the cabinet 22. Second, the playfield assembly 23 is pulled further forward until about one-half or more of the weight of the playfield assembly 23 is disposed outside of the cabinet 22. The angle of the playfield assembly 23 become steeper as the assembly is pulled forward because the pivot pin 94 remains on the respective slide rail 96 thereby supporting a portion of the weight of the playfield assembly 23 as the skid rails 84 slide on the front molding 80. Third, the playfield assembly 23 is pivoted about the front molding 80 to a generally horizontal position shown in FIG. 5. Fourth, as shown in FIG. 6, the proximal end 23*a* of the playfield assembly 23 is lowered to the floor as the skid rails 84 slide along the front molding 80. To prevent the distal end 23*b* of the playfield assembly 23 from accidentally dropping to the floor and damaging the assembly, the rear slide stops 90 are adapted to engage or "catch" on the front molding 80 when the proximal end 23*a* of the playfield assembly 23 approaches the floor.

Figure 8:
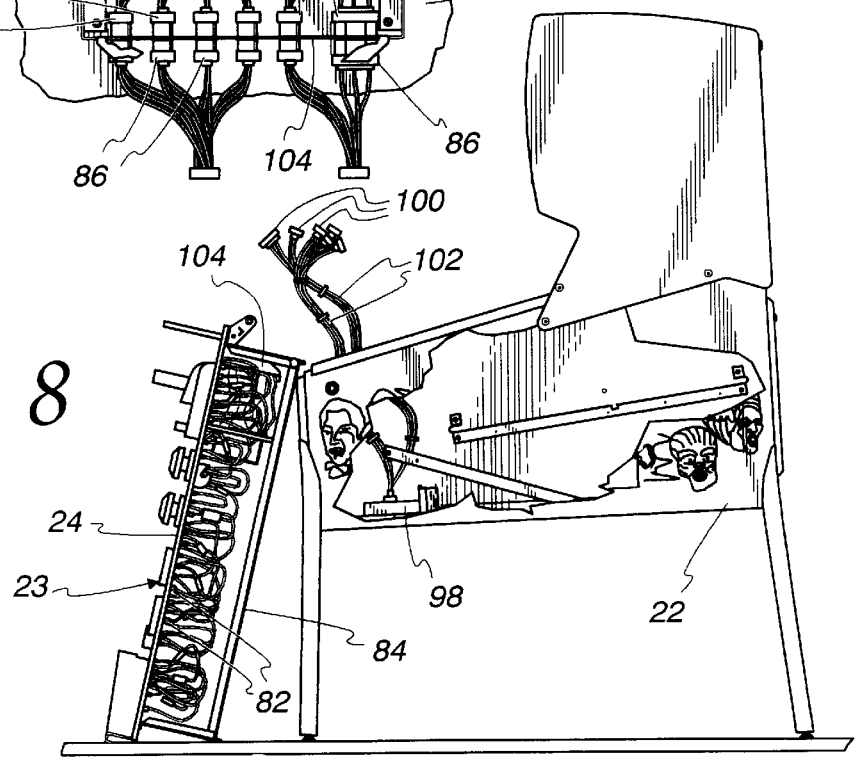
FIG. 8 is a side view of the pinball machine with portions broken away to reveal internal structure and showing the cabinet-side connectors disengaged from the connector panel.

After the playfield assembly 23 is removed from the cabinet 22 and is disposed in front of the cabinet 22 as shown in FIG. 6, the input/output elements 82 of the playfield assembly 23 are disconnected from a driver electronics board 98 mounted to a bottom of the cabinet 22. When the playfield assembly 23 is mounted to the cabinet 22, the driver board 98 is disposed beneath the playfield assembly 23. Referring to FIG. 8, the driver board 98 is electrically connected to a plurality of electrical connectors 100 by a plurality of long electrical wires 102. The electrical wires 102 are preferably bound together in one or more pigtails to facilitate handling and are sufficiently long to permit the playfield assembly 23 to be removed from the cabinet 22 without exerting stress on the electrical wires 102. The electrical wires 102 carry all playfield input/output functions of the driver board 98 to the electrical connectors 100. Therefore, all playfield input/output functions of the driver board 98 may be accessed via the electrical connectors 100, instead of from the driver board 98 itself.

Figure 7:
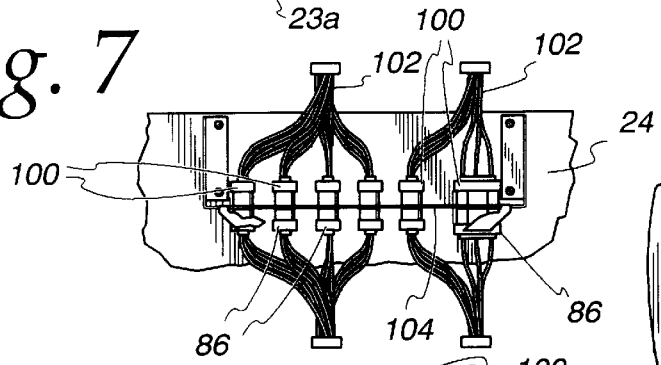
FIG. 7 is an enlarged view of a connector panel for mounting "playfield-side" connectors from the playfield assembly and "cabinet-side" connectors from electronics disposed with the cabinet.

During operation of the pinball machine 20, the "cabinet-side" connectors 100 carrying all the playfield input/output functions of the driver board 98 are electrically connected to corresponding ones of the "playfield-side" connectors 86 via a connector panel 104. An enlarged view of this connection arrangement is illustrated in FIG. 7. As shown in this figure, the connector panel 104 is mounted to the underside of the playfield 24. The playfield-side connectors 86 are mounted within respective apertures formed in the connector panel 104. The cabinet-side connectors 100 and the playfield-side connectors 86 are disposed on opposite sides of the connector panel 104, and the cabinet-side connectors 100 are plugged into the respective playfield-side connectors 86. To facilitate matching of the cabinet-side connectors 100 to the corresponding playfield-side connectors 86, each of the cabinet-side connectors 100 has a different size than remaining ones of the cabinet-side connectors 100, and the playfield-side connectors 86 generally correspond in size to respective ones of the cabinet-side connectors 100. In one embodiment, each of the cabinet-side connectors 100 has a different number of pins than remaining ones of the connectors 100, and the playfield-side connectors 86 correspond in pin count to respective ones of the cabinet-side connectors 100. If, for example, there are six cabinet-side connectors 100 having respective pin counts of 12, 16, 18, 20, 22, and 24, then there are six playfield-side connectors 86 having these same pin counts.

In an alternative embodiment, the connector panel 104 has a plurality of bridging panel connectors mounted thereto and corresponding in size (e.g. pin count) to respective ones of the cabinet-side connectors 100. To electrically connect the cabinet-side connectors 100 to the respective playfield-side connectors 86, the cabinet-side connectors 100 and the playfield-side connectors 86 are engaged to opposite sides of respective ones of the bridging panel connectors.

After the playfield assembly 23 is removed from the cabinet 22, the input/output elements 82 are disconnected from the driver electronics board 98 by disengaging the cabinet-side connectors 100 from the respective playfield-side connectors 86 as shown in FIG. 8. If the replacement playfield assembly 23' (see FIGS. 14–18) from the conversion kit provides its own connector panel, then there is no need to disengage the playfield-side connectors 86 (see FIG. 7) from the connector panel 104. However, if the connector panel 104 is to be transferred to the replacement playfield assembly 23', then the playfield-side connectors 86 must be disengaged from the connector panel 104 which, in turn, must be removed from the playfield assembly 23 and mounted to the playfield 24' (see FIGS. 14–18) of the replacement playfield assembly 23'.

After the cabinet-side connectors 100 are disengaged from the respective playfield-side connectors 86, the playfield assembly 23 is moved away from the cabinet 22 so that it cannot interfere with further steps to be performed in the conversion method. An advantageous feature of the playfield assembly 23 is that its skid rails 84 protect any components disposed beneath the playfield 24 during handling and transport of the playfield assembly 23. The reason for this is that the skid rails 84 extend further beneath the playfield 24 than these components. Accordingly, if the playfield assembly 23 is, for example, laid on the floor in a horizontal position with the skid rails 84 resting thereon, the components do not also contact the floor. In addition to protecting the components disposed beneath the playfield 24, the skid rails 84 provide the playfield assembly 23 with a fixed size that can be used for all pinball playfield assemblies made by the pinball machine manufacturer. This fixed size enables the manufacturer to employ packaging of a fixed size for storing and shipping the pinball playfield assemblies, as opposed to packaging that varies in size from one pinball assembly to the next.

Referring to FIG. 1, the conversion method optionally proceeds with the step of replacing the plunger 30 used to propel the rolling ball 26 onto the playfield 24. A different style of plunger that is better suited for the new game to be installed may compel replacing the existing plunger. For example, a fully mechanical plunger may be changed to a plunger of the type that is automatically actuated by a shooter button, or vice versa. Or, the plunger may perform poorly due to excessive wear and, therefore, may need to be replaced with a new one. If the plunger 30 is of the type that is automatically actuated by a shooter button, the conversion method may also include replacement of the shooter button.

Next, referring to FIGS. 10 and 17, a backbox panel 108 at the front of the backbox 42 is unlocked and removed from the backbox 42 in a manner described in greater detail below. In accordance with one aspect of the present invention, the removed backbox panel 108 is laid on the cabinet 22 at a location generally beneath the video display 50 such that the backbox panel 108 is capable of reflecting video images projected from the video display 50. Specifically, the cabinet 22 includes the pair of opposing sides 22*c* and 22*d*, and opposing ends of the backbox panel 108 are placed onto respective ones of the pair of opposing sides 22*c* and 22*d*. The upper surfaces of the opposing sides 22*c* and 22*d* of the cabinet 22 are sloped downward relative to a horizontal plane. Therefore, to prevent the backbox panel 108 from sliding down the downwardly sloped opposing sides of the cabinet 22, the backbox 42 includes a pair of stop elements 110 (see FIG. 1) disposed above the respective opposing sides 22*c* and 22*d* of said cabinet 22 near the front of the backbox 42. The stop elements 110 are preferably in the form of a pair of pins protruding inward from the respective opposing sides 42*a* and 42*b* of the backbox 42. The cabinet 22 provides a convenient location to place the backbox panel 108 during the conversion method. In addition, as discussed below in greater detail, the backbox panel 108 provides a partially reflective surface that can be used to perform diagnostics on a replacement playfield assembly 23' prior to sliding the glass panel 40 in FIG. 2 back onto the cabinet 22. In an alternative embodiment, the opposing sides 42*a* and 42*b* of the backbox 42, instead of the opposing sides 22*c* and 22*d* of the cabinet 22, are designed to accommodate the backbox panel 108. For example, the backbox sides 42*a* and 42*b* may be provided with respective inwardly protruding supports onto which the backbox panel 108 may be placed.

Figure 11:
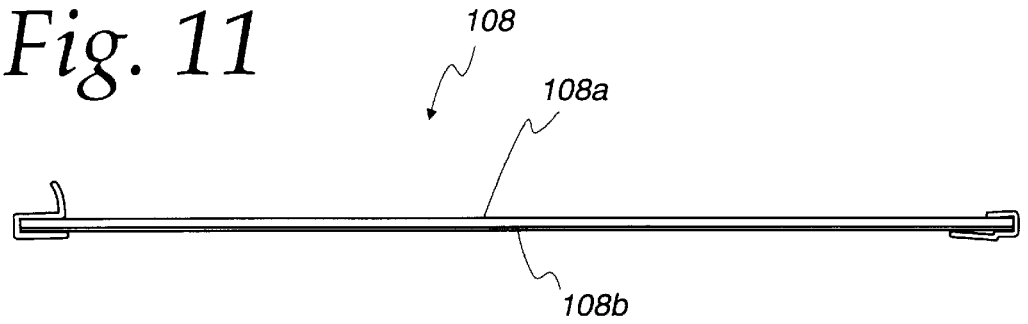
FIG. 11 is an enlarged side view of the backbox panel.

The backbox panel 108 is preferably comprised of a single sheet or a pair of overlapping sheets of glass or plastic to which artwork promoting a game theme is applied. If the backbox panel 108 is comprised of a single rigid sheet, the artwork may be incorporated directly within the sheet during the manufacture thereof. If, however, the backbox panel 108 is comprised of a pair of overlapping sheets, as shown in FIG. 11, then one of the sheets 108*a* is plain, partially reflective, and relatively rigid while the other of the sheets 108*b* includes the artwork. In the latter situation, after the backbox panel 108 is removed from the backbox 42, the decorative sheet 108*b* is optionally separated from the plain sheet 108*a* and placed to the side so that only the partially reflective sheet 108*a* is laid on the cabinet 22 generally beneath the video display 50.

Figure 9:
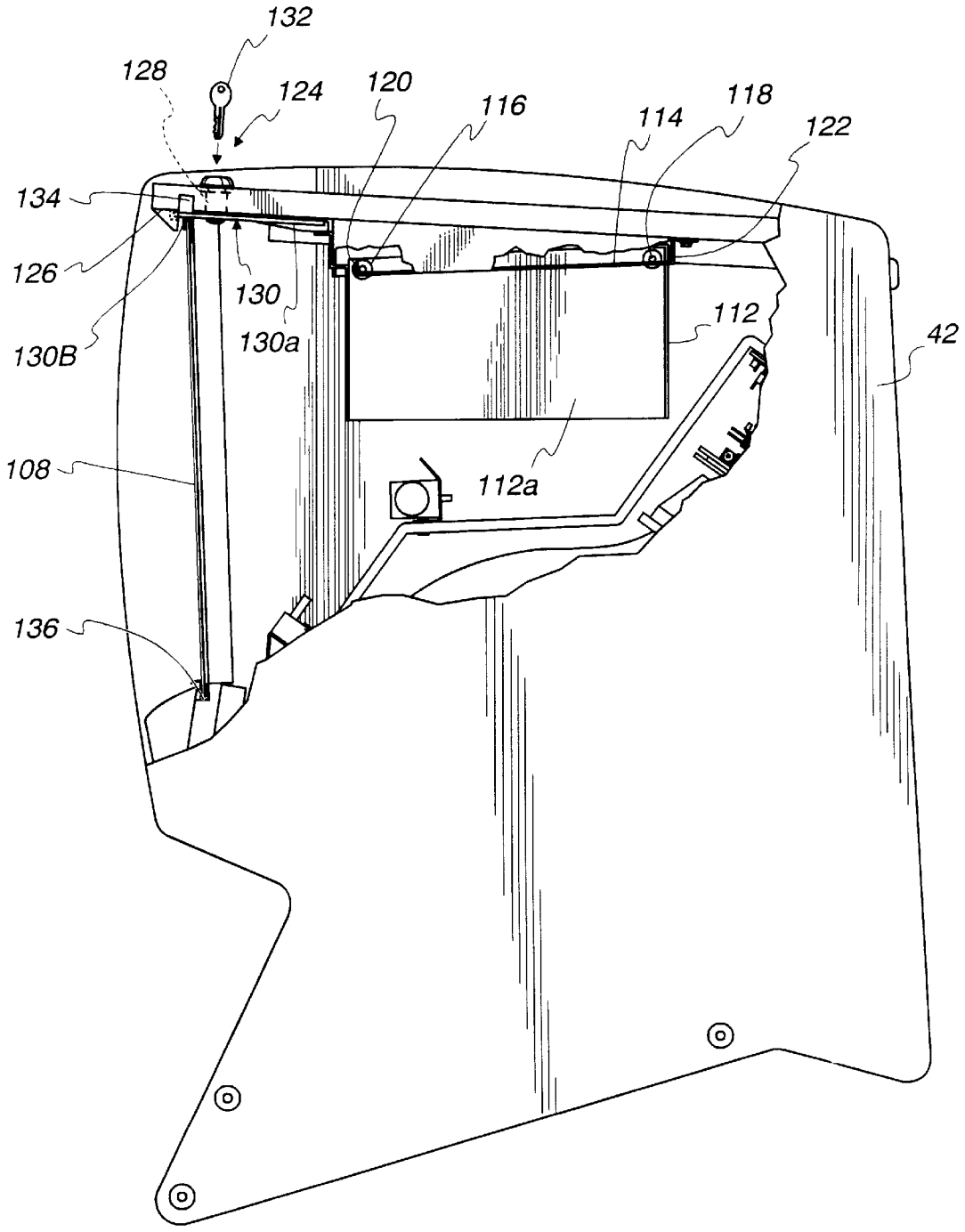
FIG. 9 is an enlarged side view of a backbox of the pinball machine with portions broken away to reveal internal structure and showing a locking mechanism for locking a backbox panel and a controller box in place.

Referring to FIG. 9, the conversion method proceeds with updating some of the electronics 70 (see FIG. 12) housed in a controller box 112 mounted within the backbox 42. To mount the controller box 112 in the backbox 42, there is provided a rail structure, preferably in the form of a pair of generally parallel rails 114 (see FIG. 12), secured within the backbox 42. For example, the rail structure can be mounted to the roof of the backbox 42. The controller box 112 is movably mounted to the rail structure to open and close the controller box 112. The controller box 112 includes a pair of opposing sides 112*a* and 112*b* (see FIG. 12) and each of the opposing sides includes a pair of front and rear pins 116 and 118 spaced from each other. The spaced pins 116 and 118 of each of the opposing box sides are disposed on the respective rail 114 when the controller box 112 is closed as shown in FIG. 9. Each of the rails 114 includes front and rear lips 120 and 122 at opposite ends of the respective rail 114 for preventing the spaced pins 116 and 118 from sliding off of the respective rail 114. The front and rear pins 116 and 118 of each of the opposing box sides are adjacent to the respective front and rear lips 120 and 122 of the respective rail 114 when the controller box 112 is closed as shown in FIG. 9.

Referring to FIG. 9, an advantageous feature of the present invention is that a locking mechanism 124 mounted to the roof of the backbox 42 serves both to lock the backbox panel 108 to the front 126 of the backbox 42 and to maintain the controller box 112 in a closed position. Operation (unlocking) of the locking mechanism 124 thereby serves to release the backbox panel 108 from the front 126 of the backbox 42 and to allow the controller box 112 to be opened. The locking mechanism 124 includes a cylindrical shaft 128 and a locking arm 130. The cylindrical shaft 128 is rotatably mounted within a hollow cylindrical member (not shown) that is fixedly mounted to the roof of the backbox 42. The locking arm 130 is rigidly mounted to the rotatable shaft 128 and includes first and second elongated arm portions 130*a* and 130*b* extending outward from the rotatable shaft 128 in opposite radial directions. The locking arm 130 is disposed within the backbox 42 adjacent to the roof thereof and at a front end thereof. The rotatable shaft 128 forms a keyhole (not shown) at one end thereof. The keyhole is accessible from outside the backbox 42 and accepts a key 132 that is typically under the control of an operator. Inserting the key 132 into the keyhole and turning the key causes the shaft 128 to rotate which, in turn, causes the locking arm 130 to rotate between a locked position and an unlocked position.

In the locked position depicted in FIG. 9, the radially outermost end of the first arm portions 130*a* of the locking arm 130 is disposed immediately adjacent to the front of the controller box 112. As a result, the first arm portion 130*a* maintains the controller box 112 in a closed position by inhibiting movement of the controller box 112 away from the closed position. In particular, the arm portion 130*a* prevents the front pin 116 of each of the opposing sides of the controller box 112 from being lifted off the respective rail 114 and over the respective front lip 120. Locking the controller box 112 in such a manner protects the electronics 70 housed within the controller box 112 during shipping and handling. Because the controller box 112 includes expensive electronics, the controller box 112 may also be locked within the backbox 42 through another basic lock, such as a padlock, to avoid theft.

While the first arm portion 130*a* maintains the controller box 112 in the closed position, the second arm portion 130*b* locks the backbox panel 108 to the front 126 of the backbox 42. This is accomplished as follows. The backbox 42 forms upper and lower slots 134 and 136 located at opposite ends of a frontal backbox opening covered by the installed backbox panel 108. When the backbox panel 108 is mounted to the front 126 of the backbox 42, the backbox panel 108 sits in the lower slot 136 but not in the upper slot 134. The lower end of the backbox panel 108 is disposed within the lower slot 136. To remove the backbox panel 108 from the front 126 of the backbox 42, the backbox panel 108 must be raised out of the lower slot 136 and temporarily into the upper slot 134, and then the lower end of the backbox panel 108 must be pulled forward to remove the backbox panel 108 from the front 126 of the backbox 42. However, in the locked position depicted in FIG. 9, the arm portion 130*b* of the locking arm 130 blocks the upper slot 134 so as to prevent the backbox panel 108 from being raised out of the lower slot 136. As a result, the backbox panel 108 is effectively locked to the front 126 of the backbox 42.

Figure 10:
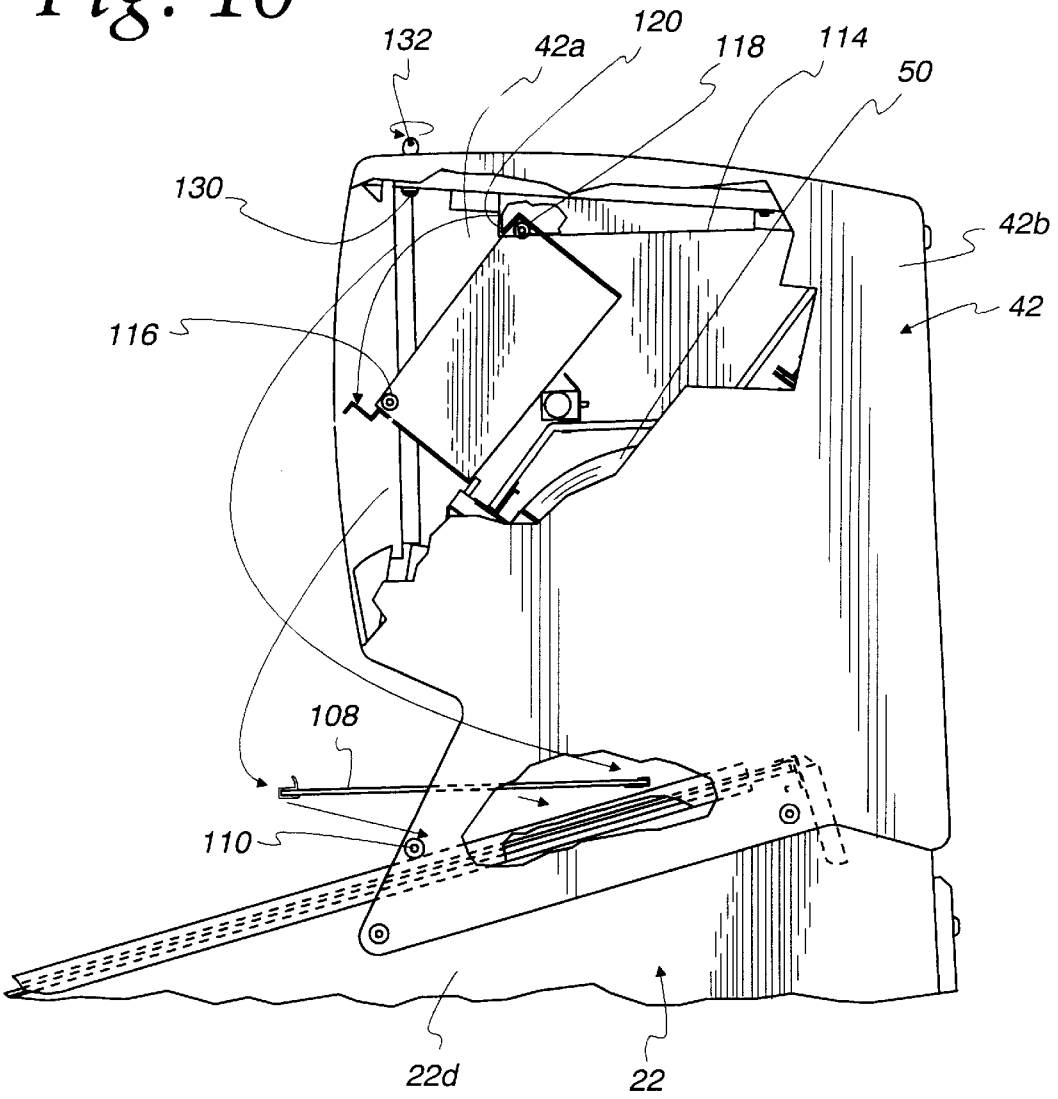
FIG. 10 is a partial side view of the pinball machine with portions broken away to reveal internal structure and showing the locking mechanism operated to release the backbox panel from the backbox for positioning on the cabinet and to allow the controller box to be opened.

In the unlocked position depicted in FIG. 10, the locking arm 130 is disposed 90 degrees away from its locked position. Specifically, the first arm portion 130*a* is spaced a sufficient distance away from the front of the controller box 112 to allow the controller box 112 to be opened. The second arm portion 130*b* no longer blocks the upper slot 134 and, therefore, allows the upper slot 134 to be utilized to remove the backbox panel 108 from the front 126 of the backbox 42 in the manner described above.

Figure 12:
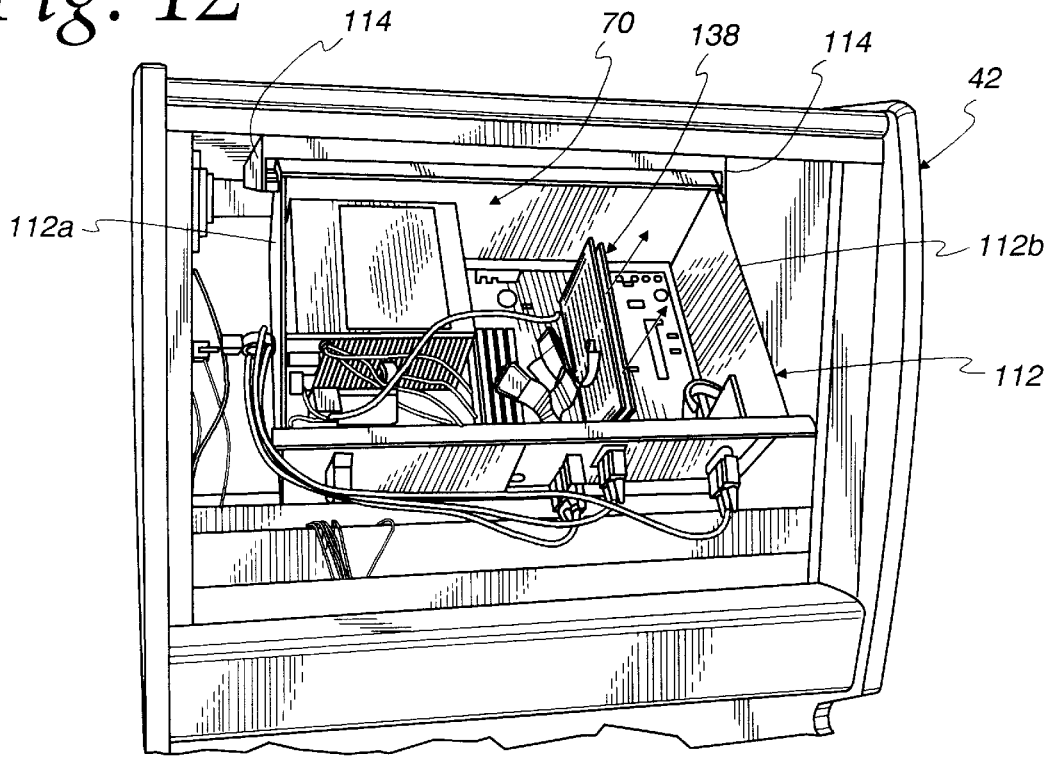
FIG. 12 is a frontal perspective view of the backbox with the backbox panel removed to reveal internal structure and the controller box opened.

Referring to FIGS. 9 and 10, to allow the controller box 112 to be opened, the locking arm 130 must be disposed in its unlocked position. Since the locking arm 130 should have previously been rotated to the unlocked position to release the backbox panel 108 from the front 126 of the backbox 42, the locking arm 130 should already be in the unlocked position. To open the controller box 112, the front pin 116 of each of the opposing box sides is first lifted off of the respective rail 114 and over the respective front lip 120. Next, the controller box 112 is pulled open. This pulling action causes the rear pin 118 of each of the opposing sides to slide forward along the respective rail 114 as shown in FIG. 10. In addition, since the front pin 116 of each of the opposing sides is not supported by the respective rail 114, the controller box 112 may be simultaneously pivoted downward as shown in FIGS. 10 and 12 to expose the electronics 70 housed within the controller box 112. As shown in FIG. 10, the controller box 112 can be slid forward until the rear pin 118 of each of the opposing sides contacts the front lip 120 of the respective rail 114. Also, the controller box 112 can be pivoted downward until the front end of the controller box 112 contacts the backbox 42 or a component disposed therein. Because of the structural support provided by the backbox 42, the controller box 112 is held steady in its downwardly rotated position to allow sufficient access by the technician.

If desired, the controller box 112 may be removed completely from the backbox 42 by lifting the rear pin 118 of each of the opposing sides off of the respective rail 114 and over the respective front lip 120. One situation where it would be desirable to remove the controller box 112 from the backbox 42 is to perform bench tests on the electronics 70 housed therein.

Figure 13:
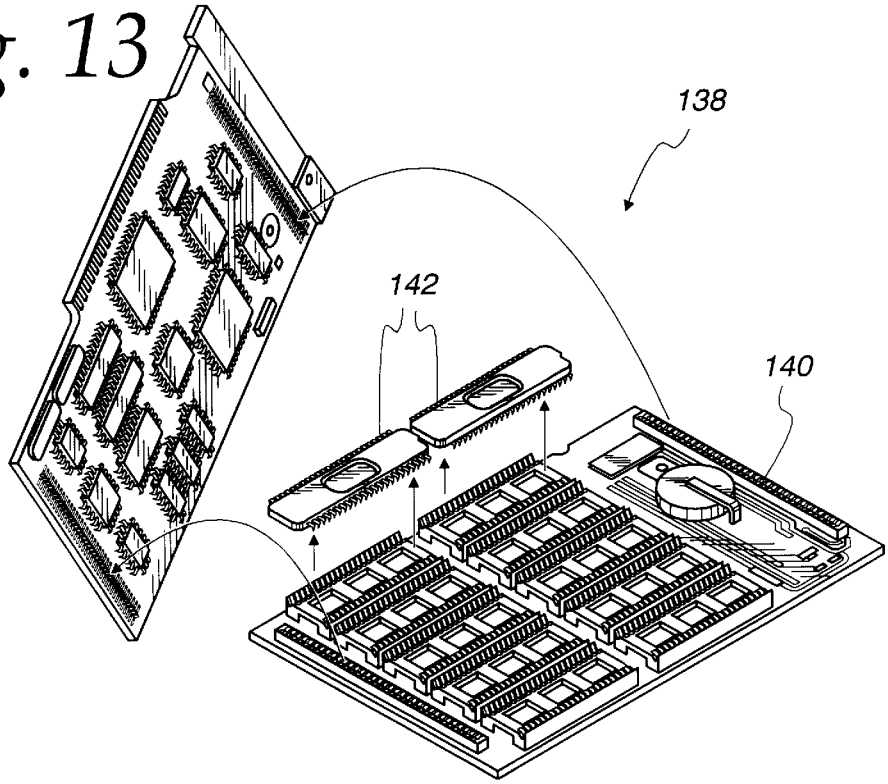
FIG. 13 is an exploded perspective view of a PCI bus card assembly removed from the opened controller box in FIG. 12 and showing memory chips being removed from a daughter card of the assembly.

Referring to FIGS. 12 and 13, the electronics 70 housed in the controller box 112 are used to control the operation of the pinball machine 20. These electronics 70 are electrically connected to the driver board 98 (see FIG. 2) housed within the cabinet 22 beneath the playfield assembly 23 by a signal-carrying cable. The electronics 70 include a PCI bus card assembly 138 having a detachable daughter card 140. The daughter card 140 contains memory chips 142 for storing a game program, game sounds, and video images. In the conversion method, the pinball machine 20 is updated to include a replacement game program, replacement game sounds, and replacement video images. In one embodiment, such updating is accomplished by downloading the replacement program, sounds, and images from an external storage device located at a remote site via a signal-carrying cable. For example, the replacement information may be available at the manufacturer's web site on the Internet and downloaded therefrom via a telephone or coaxial cable line. Of course, proper security access codes may be needed to retrieve the replacement information from the manufacturer's web site.

Alternatively, the technician tasked with the retrofitting process would carry with him or her a portable computer which would contain within its memory the replacement information. The computer would be connected to an associated port within the electronics 70 via a signal-carrying cable for downloading the replacement information for the new game. Because of the possibility of having several new games from which the owner of the pinball machine 20 can choose for conversion, the invention contemplates having the necessary replacement information for several games stored within the portable computer used by the technician.

The electronics 70 also may include a simple memory disc drive (e.g. a floppy disc) which receives a disc with the new replacement information. Thus, the electronics would then transfer the replacement information from the disc into the memory of the electronics. Or, the system could operate simply by relying on pulling the information from the disc during normal pinball operation. In other words, the technician simply replaces the first game disc with a second game disc.

In yet another embodiment, the technician replaces the memory chips 142 with new memory chips supplied with the conversion kit. To accomplish this, the PCI bus card assembly 138 is removed from the controller box 112, the daughter card 140 is disengaged from the PCI bus card assembly 138, and the memory chips 142 are removed from the daughter card 140. New memory chips supplied with the conversion kit are then installed into the daughter card 140, the daughter card 140 engaged to the PCI bus card assembly 138, and the PCI bus card assembly 138 is placed back into the controller box 112. As the chips are easily snapped into place, the overall change in memory can be accomplished in a matter of minutes.

While the replacement of the game information has been described thus far in the form of a new game, it should be noted that the pinball machine 20 may require an updated version of the game instructions without changing the playfield assembly 23. Thus, these various methods for downloading game information can be used to simply update the version of the operation instructions for the present pinball game. This may be done, for example, to provide enhanced sound or visual features. By doing so, the versatility of the pinball game brought about by the projected video images is accentuated. The complexion and feel of one pinball game can be altered by merely updating the game instructions, video images, and sound information. The end result is an inexpensive method by which the owner of the pinball machine 20 maintains a high level of pinball player loyalty to the same pinball machine by this change of the memory.

Referring to FIGS. 9, 10, and 12, to close the controller box 112, the above-noted steps for opening the controller box 112 are typically performed in reverse order. Specifically, if the controller box 112 has been completely removed from the backbox 42, the rear pin 118 of each of the opposing sides is lifted over the respective front lip 120 and onto the respective rail 114. Next, while lifting the front end of the controller box 112 so that it stays clear of the backbox 42, the controller box 112 is pushed closed. This pushing action causes the rear pin 118 of each of the opposing sides to slide rearward along the respective rail 114. In addition, since the front pin 116 of each of the opposing sides is not supported by the respective rail 114, the controller box 112 may simultaneously be pivoted upward. The controller box 112 can be slid rearward until the front pin 116 of each of the opposing sides reaches the front lip 120 of the respective rail 114. At this point, the front pin 116 of each of the opposing sides is lifted over the respective front lip 120 and onto the respective rail 114. The controller box 112 is now fully closed.

Figure 14:
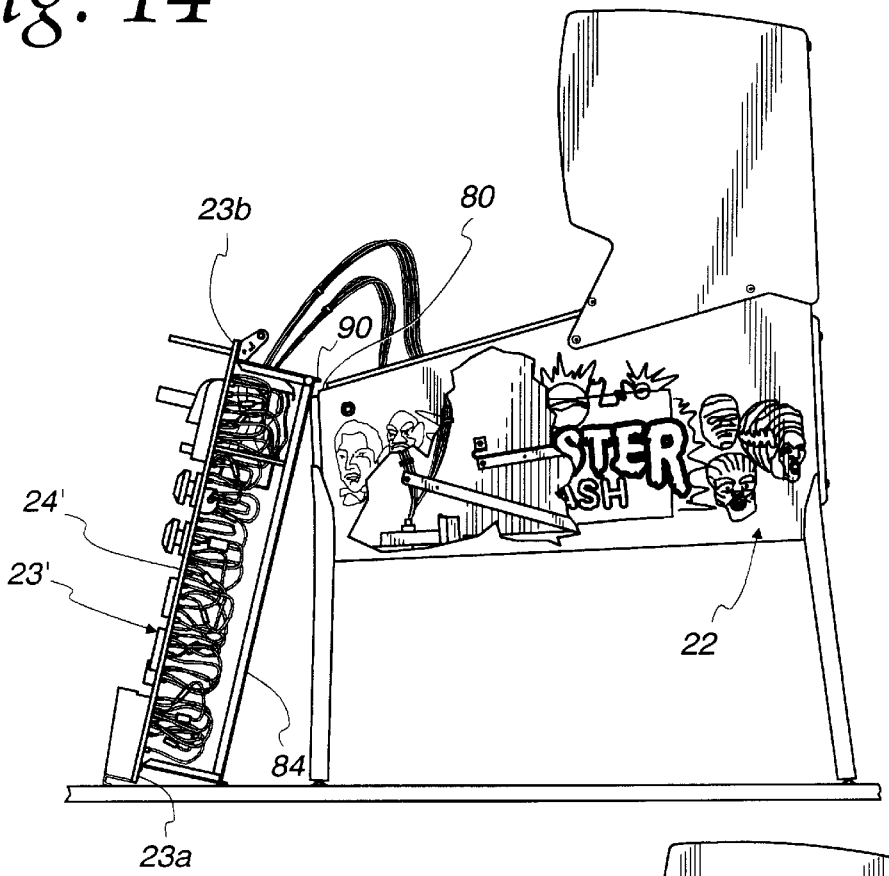
FIG. 14 is a side view of the pinball machine with portions broken away to reveal internal structure and showing a replacement playfield assembly for installation in the cabinet.

Referring to FIGS. 14–17, the conversion method proceeds with installation of the replacement playfield assembly 23' supplied with the conversion kit. To install the replacement playfield assembly 23', the above-noted steps for removing the original playfield assembly 23 are performed in generally the reverse order with the additional step of performing diagnostics on the replacement playfield assembly 23' prior to completing installation thereof. Specifically, the replacement playfield assembly 23' is positioned at the front of the cabinet 22 as shown in FIG. 14 with the proximal end 23*a*' of the playfield assembly 23' resting on the floor and the skid rails 84 resting against the front of the cabinet 22. To prevent the distal end 23*b*' of the playfield assembly 23' from accidentally dropping to the floor and damaging the assembly, the rear slide stops 90 of the respective skid rails 84 are adapted to engage or "catch" on the front molding 80 of the cabinet 22. Next, the cabinet-side connectors 100 and the playfield-side connectors 86 are engaged to each other via a connector panel 104 (see FIG. 7) mounted to the underside of the replacement playfield 24'. The connector panel 104 may be the same one that was mounted to the original playfield 24 and transferred to the replacement playfield assembly 23' or, alternatively, may be a different connector panel akin to the one that was mounted to the original playfield 24.

Figure 15:
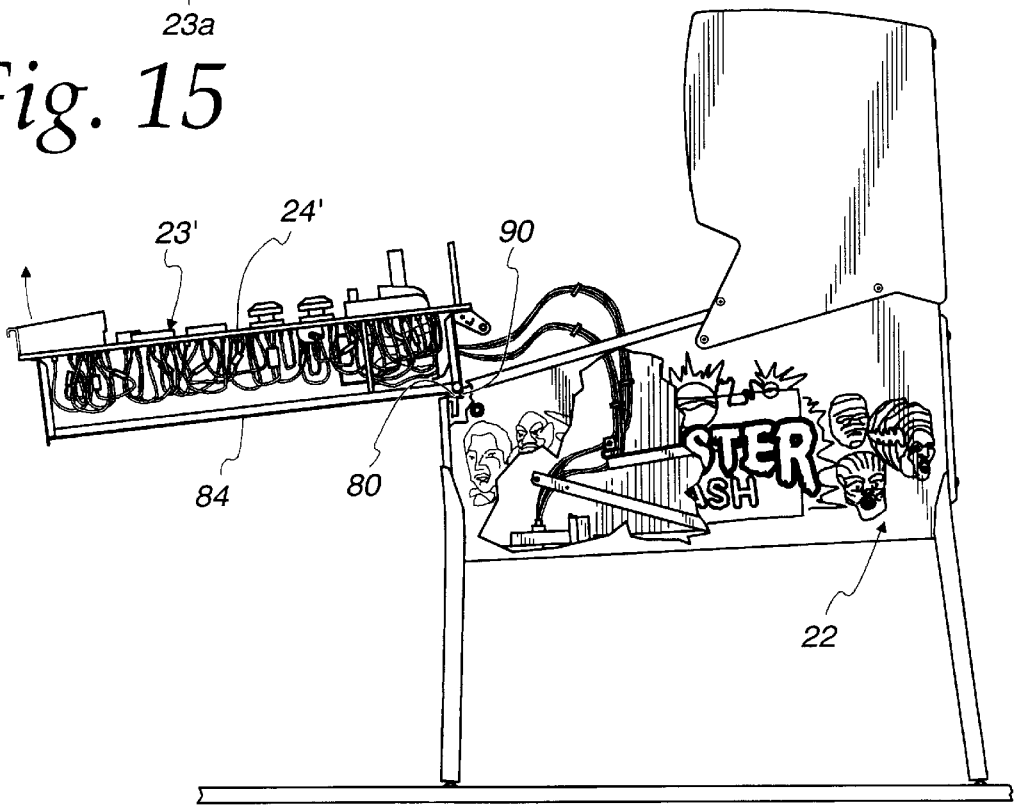
FIGS. 15 and 16 are side views of the pinball machine with portions broken away to reveal internal structure and showing the replacement playfield assembly being installed into the cabinet.
Figure 16:
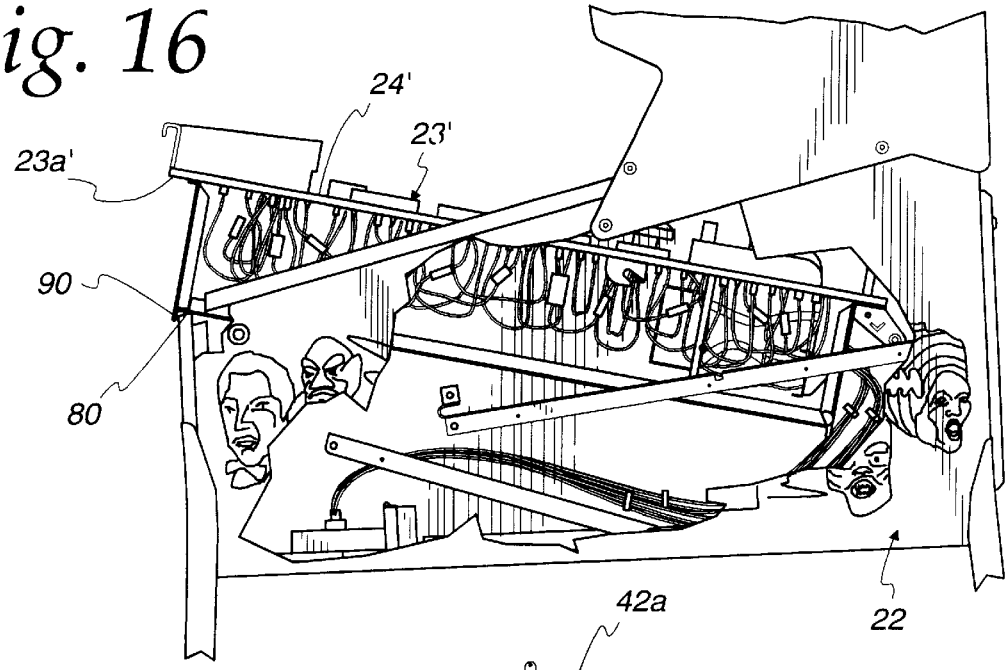
Figure 17:
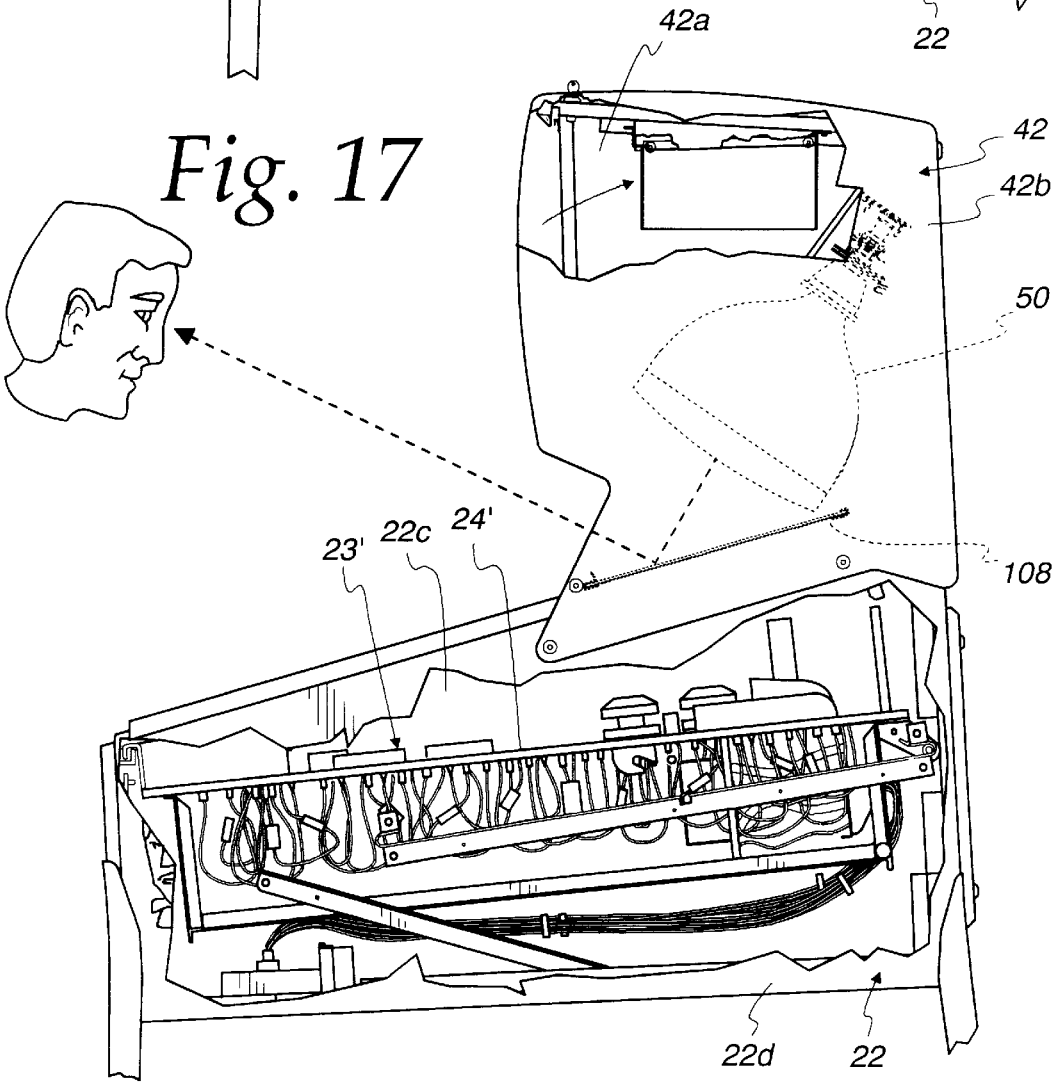
FIG. 17 is a side view of the pinball machine with portions broken away to reveal internal structure and showing the replacement playfield assembly installed into the cabinet and diagnostics being performed on the replacement playfield assembly using the backbox panel to reflect diagnostic-related video images projected from a video display.

After engaging the cabinet-side and playfield-side connectors 100 and 86 to each other via the connector panel 104, the replacement playfield assembly 23' is lifted and slid into the cabinet 22 as shown in FIGS. 15–17. The steps for installing the replacement playfield assembly 23' are performed in the reverse order of the steps for removing the original playfield assembly 23 from the cabinet 22. To prevent the proximal end 23*a*' of the playfield assembly 23' from accidentally dropping into the cabinet 22 and damaging the assembly when the assembly is in the position depicted in FIG. 16, the front slide stops 90 are adapted to engage or "catch" on the front molding 80. The replacement playfield assembly 23' is then lifted upward to elevate the front slide stops 90 above the front molding 80 and allow the playfield assembly 23' to be slid rearwardly and lowered into the cabinet 22. FIG. 17 depicts the replacement playfield assembly 23' after it has been lowered into the cabinet 22.

Referring to FIG. 17, after the replacement playfield assembly 23' is installed in the cabinet 22, diagnostics are preferably performed on the pinball machine 20 to insure that the pinball machine 20, and especially the replacement playfield assembly 23', are working properly. To perform diagnostics, the pinball machine's electrical cord is plugged into a power outlet and the pinball machine's power switch is turned on. In response to turning on the power switch, the video display 50 projects video images in a downward direction toward the playfield assembly. To allow an operator to easily view these images without having to bend awkwardly and look directly at the video display 50, a partially reflective member is temporarily positioned generally beneath the video display 50 such that the partially reflective member reflects the video images projected from the video display 50. The backbox panel 108, which was placed on the cabinet 22 earlier in the conversion method, preferably serves as this partially reflective member.

Figure 22:
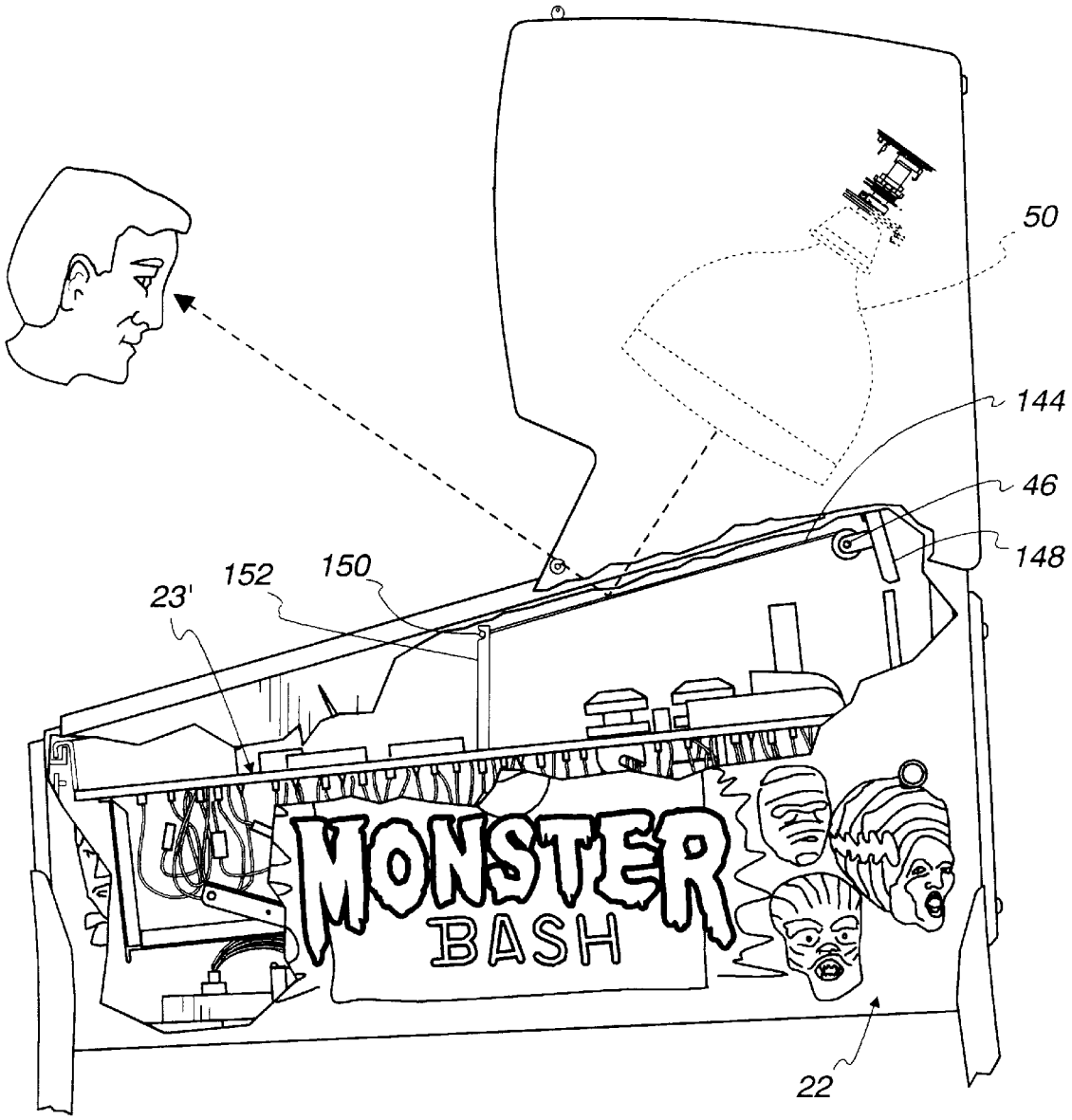
FIG. 22 is a side view of the pinball machine with portions broken away to reveal internal structure and showing the replacement playfield assembly installed into the cabinet and diagnostics being performed on the replacement playfield assembly using a retractable shade to reflect diagnostic-related video images projected from the video display.

In an alternative embodiment depicted in FIG. 22, the backbox panel 108 does not serve as the partially reflective member for purposes of performing diagnostics. Rather, the backbox panel 108 is placed off to the side, while a retractable shade 144 serves as the partially reflective member. The shade 144 is preferably composed of flexible plastic such as MYLAR. The shade 144 is movable between a retracted position and an extended position. In the retracted position, the shade 144 is wound about a rod or spool 146 and is not capable of reflecting the video images projected from the display 50. The rod 146 is mounted to a board 148 disposed proximate to a rear of the cabinet 22. Except when performing diagnostics, the shade 144 is disposed in the retracted position. To perform diagnostics, the shade 144 is moved from the retracted position to the extended position shown in FIG. 22. The leading end of the shade 144 includes a first latching member 150 such as pins or holes, while the cabinet 22 contains a second latching member 152 such as posts, hooks, or notches (depending upon the first latching member) for engaging the first latching member. In the illustrated embodiment, the first latching member 150 includes a pair of pins protruding laterally from opposite sides of the leading end of the shade 144, and the second latching member 152 includes a pair of posts extending upwardly from opposing sides of the playfield. The posts form terminal notches for capturing the respective pins. By engaging the first and second latching members 150 and 152, the shade 144 is maintained in the extended position in an orientation suitable for reflecting the video images projected from the video display 50.

After positioning the partially reflective member generally beneath the video display 50, the operator operates user interface controls mounted somewhere on the pinball machine 20 such as on the inside of the coin door 76 (see FIG. 3) to cause the video display 50 to project images containing diagnostic information. Using this diagnostic information, the operator tests the functions of the pinball machine 20.

Figure 18:
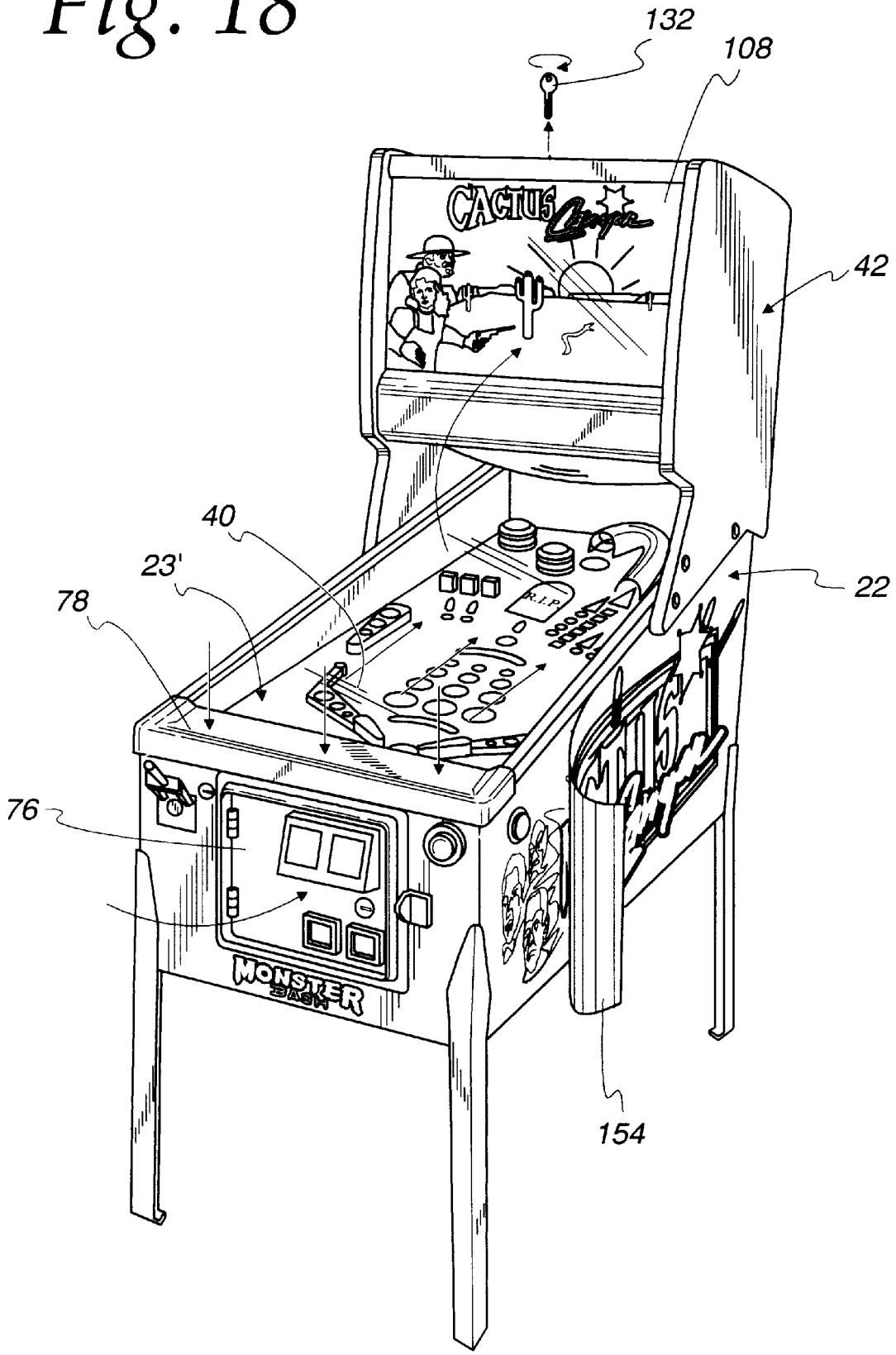
FIG. 18 is a perspective view of the pinball machine after it has been converted from the first pinball game to the second pinball game.

Referring to FIG. 18, if the pinball machine 20 works properly, the conversion method proceeds with mounting the backbox panel 108, or a replacement therefore, to the front of the backbox 42. If the backbox panel 108 was comprised of a single sheet of glass or plastic, then the backbox panel 108 must be replaced by an entirely new backbox panel 108 containing artwork corresponding to the new pinball game. If, however, the backbox panel was comprised of a pair of overlapping sheets, only the decorative sheet containing the artwork of the original pinball game must be replaced by a new decorative sheet. Once the backbox panel 108 is mounted to the backbox 42, the locking mechanism is operated by the key 132 to both lock the backbox panel 108 to the front of the backbox 42 and to maintain the controller box 112 (see FIG. 9) in its closed position.

Finally, the conversion method is completed by sliding the glass panel 40 onto the cabinet 22 over the replacement playfield assembly 23', engaging the handguard 78 to the front molding 80 of the cabinet 22, closing the coin door 76, and applying the replacement decals 154 from the conversion kit over the existing artwork on the cabinet 22 and backbox 42. The replacement decals 154 are designed to go over the existing artwork. To apply the replacement decals 154, the cabinet and backbox areas where the decals 154 will be applied are wetted with a solution of soapy water. The decals are applied and properly positioned while these areas are wet. A flat, smooth-edged tool, such a ruler or a squeegee, is rubbed over the replacement decals 154 to remove excess water and air bubbles.

Figure 19:
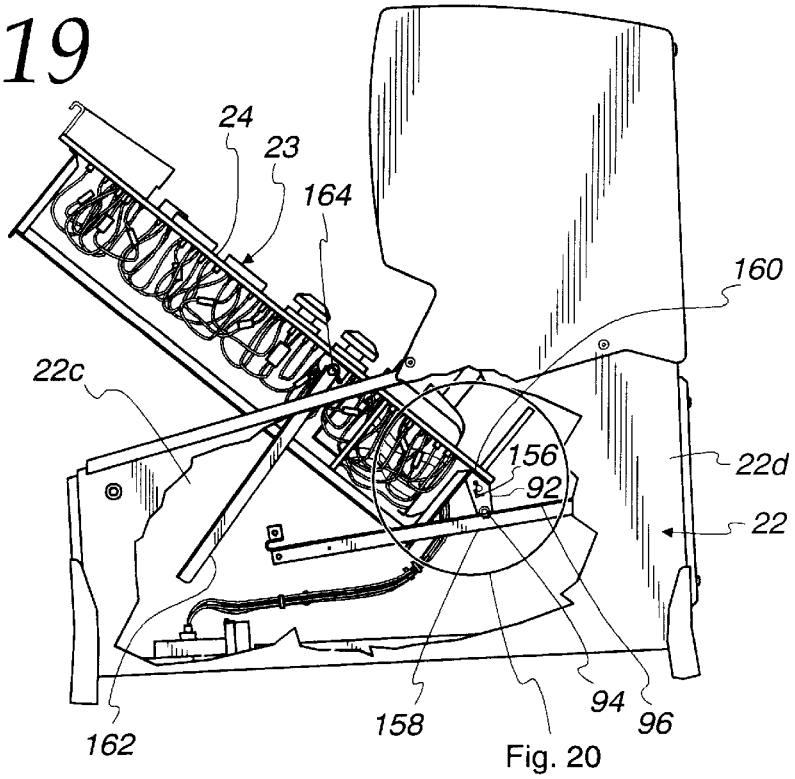
FIG. 19 is a side view of the pinball machine with portions broken away to reveal internal structure and showing the playfield assembly raised partially upward within the cabinet for maintenance and servicing.

Occasionally, it may be desirable for an operator to quickly access a region of the cabinet 22 located below the playfield 24 or components mounted on the underside of the playfield 24, without having to entirely remove the playfield assembly 23, for maintenance and repair purposes. Referring to FIGS. 19 and 20, each bracket 92 at the distal end of the playfield 24 includes an L-shaped stop element 156 protruding laterally away from the playfield 24, and each slide rail 96 on the cabinet 22 includes a centrally-located discontinuity in the form of notch 158. The pivot pin 94 is sized to fit within the notch 158 of respective slide rail 96. Also, each of the opposing sides 22*c* and 22*d* of the cabinet 22 includes a respective stop pin 160 adapted to engage the respective L-shaped stop element 156 as described below.

Referring to FIG. 19, to access the cabinet region beneath the playfield 24, the operator performs the following steps. First, the coin door 76 is opened, the handguard 78 is detached from the cabinet 22, and the glass panel 40 is slid off the cabinet 22 (see FIG. 3). Second, the playfield assembly 23 is angled upward and pulled forward until each pivot pin 94, which slides along the respective slide rail 96, sits within the notch 158. Third, with each pivot pin 94 engaged to the respective notch 158, the playfield assembly 23 is rotated upwardly around the notch 158 such that the playfield assembly 23 is at an angled position with respect to the slide rails 96 to at least partially expose the region of the cabinet 22 below the playfield assembly 23. To define the angled position, the stop pin 160 of the cabinet 22 engages the L-shaped stop element 156 of the playfield bracket 92 to prevent further rotation of the playfield assembly 23 about the notch 158. Fourth, to maintain the playfield assembly 23 at the angled position depicted in FIG. 19, the pinball machine 20 is provided with a stay arm 162. Specifically, one end of the stay arm 162 is rotatably mounted to one of the opposing cabinet sides, e.g., cabinet side 22*d*, while the other end includes a first latching member 164 in the form of a pin or notch. The playfield assembly 23 includes a second latching member 166 (see FIG. 21) in the form of a pin or notch (depending upon the first latching member). The stay arm 162 is rotated upwardly about its first end, and the first latching member 164 is engaged to the second latching member 166. With the playfield assembly 23 in the illustrated position, the operator may proceed with maintenance and servicing of the pinball machine 20.

Figure 21:
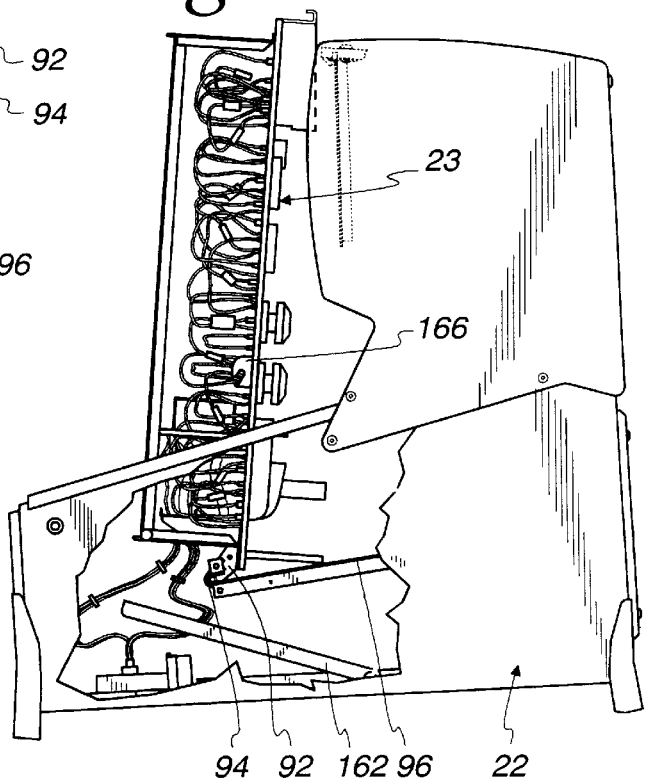
FIG. 21 is a side view of the pinball machine with portions broken away to reveal internal structure and showing the playfield assembly raised to a nearly vertical position within the cabinet for maintenance and servicing.

Referring to FIG. 21, if the operator must service the lower side of the playfield assembly 23, especially distal portions thereof, the operator performs the following steps. First, the stay arm 162 is disengaged from the playfield assembly 23 and rotated downward back into the cabinet 22. Second, the pivot pin 94 is slid forward along the respective slide rail 96 beyond the notch 158 until it is captured in the hook-shaped front end of the slide rail 96. Third, the playfield assembly 23 is rotated upwardly about the hook-shaped front end until the playfield assembly 23 is substantially vertical as shown in FIG. 21.

After the operator has completed maintenance and servicing of the pinball machine 20, the playfield assembly 23 is returned to its original position within the cabinet 22. Lastly, the glass panel 40 is slid onto the cabinet 22, the handguard 78 is engaged to the front of the cabinet 22, and the coin door 76 is closed (see FIG. 18).

Figure 23:
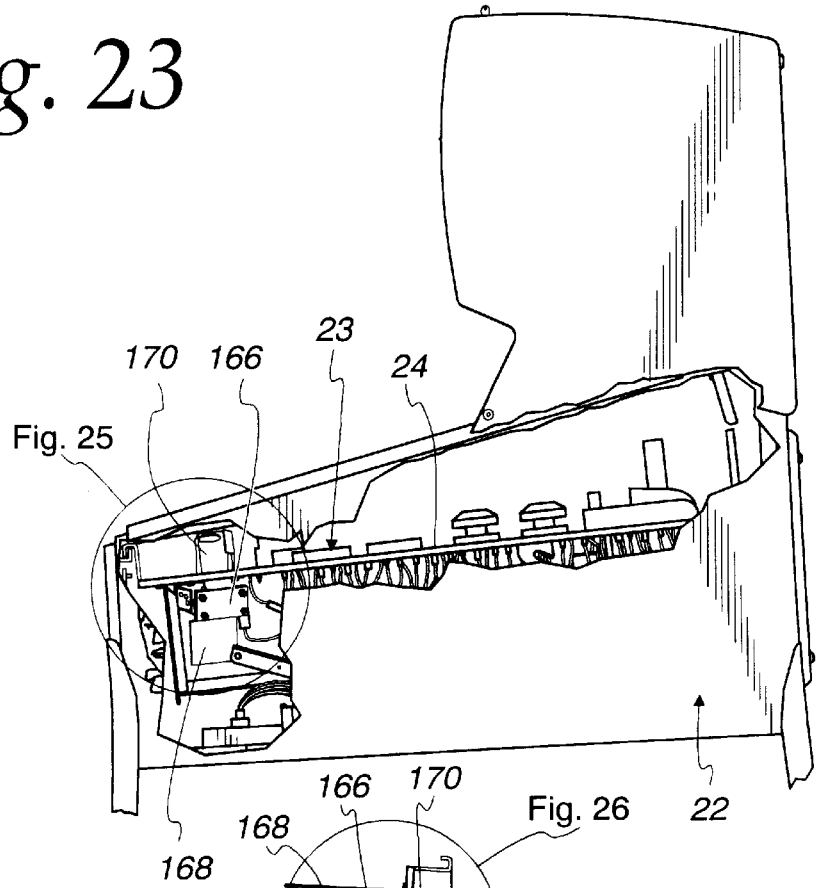
FIG. 23 is a side view of the pinball machine with portions broken away to reveal internal structure and showing a prior art ball trough for delivering rolling balls exiting the playfield back to the playfield.

Referring to FIGS. 23 and 25, the proximal end of the playfield 24 near the flippers 34 (see FIG. 1) forms a drain where rolling balls 26 exit and drop underneath the playfield 24 into a ball storage trough or conduit 166. The ball trough 166 is angled such that the balls 26 roll by gravity generally over toward the plunger 30 (see FIG. 1). A solenoid mechanism 168 extending into the trough 166 pushes each ball 26 upwardly through an exit aperture 170 and onto the playfield 24 such that it can be acted upon by the plunger 30. The aperture 170 is disposed in close proximity to the plunger.

Figure 24:
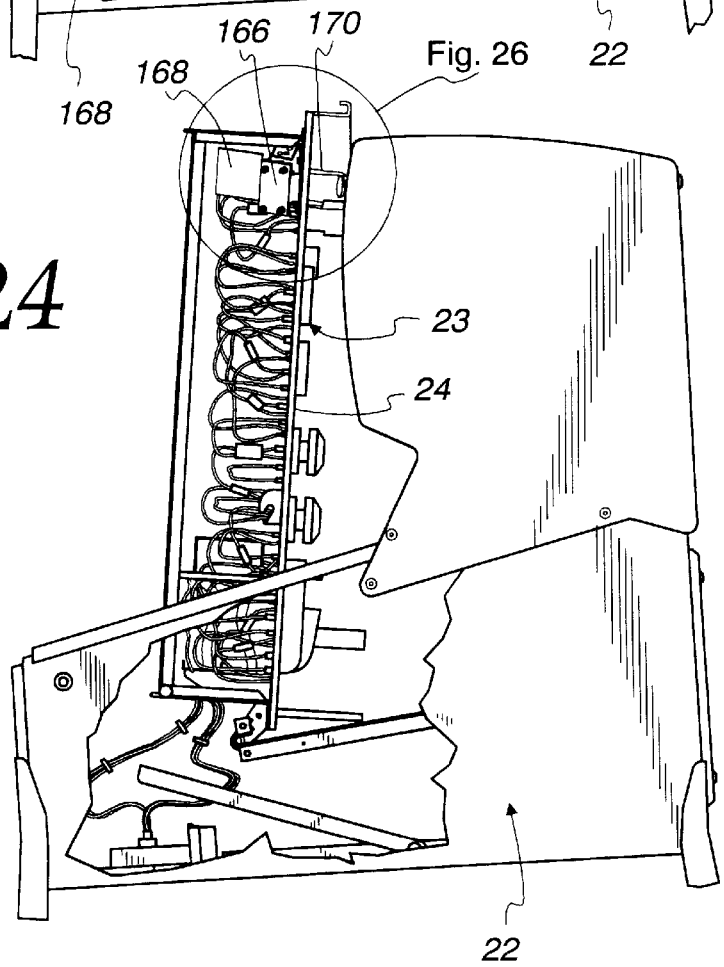
FIG. 24 is a side view of the pinball machine in FIG. 23 with the playfield tilted upwardly for maintenance and servicing.

Heretofore, as shown in FIGS. 24 and 26, when the playfield assembly 23 was tipped upwardly for maintenance and servicing, the rolling balls 26 would tend to fall out of the trough 166 via the exit aperture 170 and crash into the cabinet 22. To prevent the rolling balls 26 from falling out of the trough 166, the operator would need to remove the balls 26 from the trough 166 prior to raising the playfield assembly 23 or catch any balls 26 that would fall out of the trough 166 while raising the playfield assembly 23.

Figure 27:
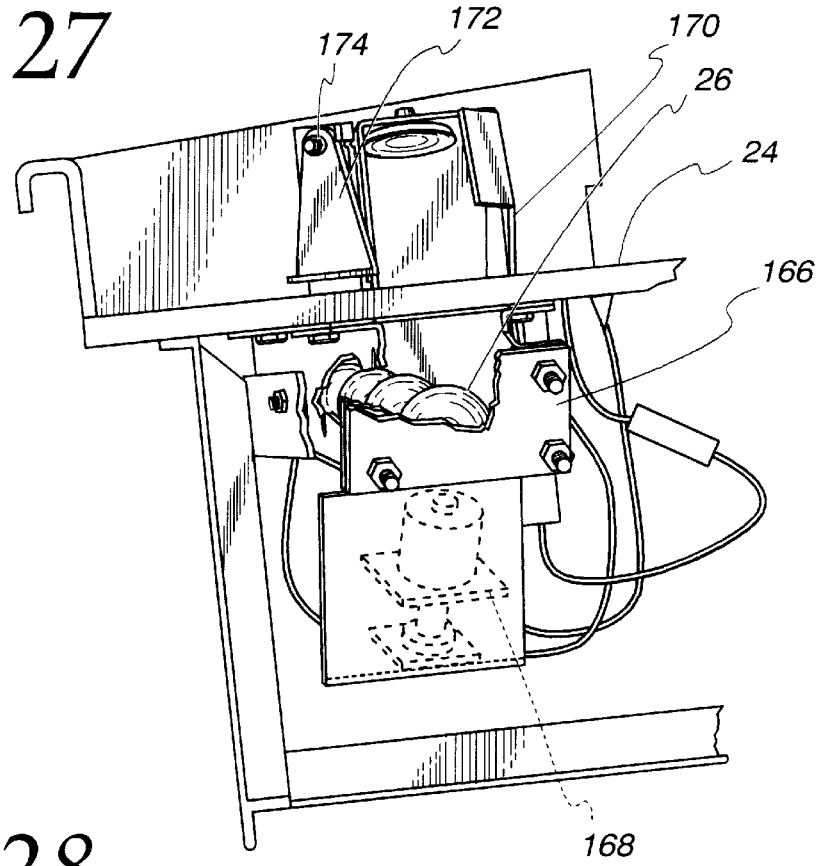
FIG. 27 is a magnified view of a ball trough having a ball block assembly in an open position to allow rolling balls in the ball trough to be dispensed therefrom when the playfield is disposed within the cabinet of the pinball machine.
Figure 28:
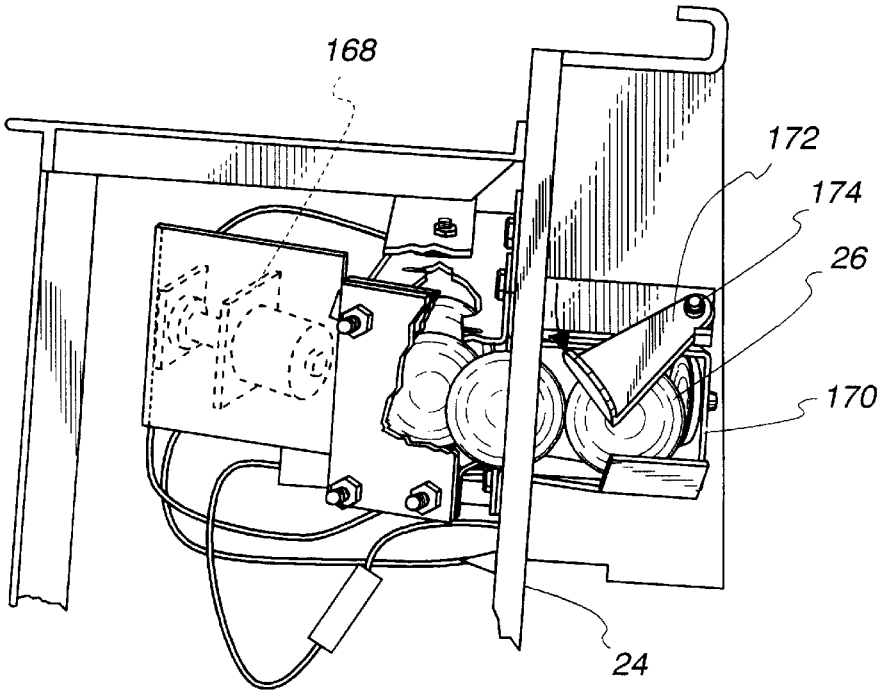
FIG. 28 is a magnified view of the ball trough in FIG. 27 having the ball block assembly in a closed position to prevent the rolling balls from falling out of the ball trough when the playfield is tilted upwardly for maintenance and servicing.

Referring to FIGS. 27 and 28, to prevent the rolling balls 26 from falling out of the ball trough 166, the playfield assembly 23 includes a passive ball block 172 in the form of a hinged door. The door 172 is preferably composed of metal or rigid plastic. Gravity moves the door 172 to an open position (FIG. 27) when the pinball machine 20 is operational, i.e. the playfield assembly 23 is disposed within the cabinet 22 as shown in FIG. 23; and gravity rotates the door 172 to a closed position blocking the exit aperture 170 (FIG. 28) when the playfield assembly 23 is tipped upwardly for maintenance and servicing as shown in FIG. 24 thereby prohibiting the balls 26 from exiting the trough 166 through the aperture 170. In a preferred embodiment, the door 172 is rotatably mounted to a post 174 on the playfield assembly adjacent to the aperture 170, is triangular in shape, and rotates about one of its three apexes. As the playfield assembly 23 is tilted upwardly, the door 172 is acted upon by gravity such that it remains relatively in the same position with respect to the gravity, but the rotation of the playfield assembly 23 causes the door 172 to rotate in front of the exit aperture 170.

In an alternative embodiment, the door 172 is active instead of passive. In this case, the door 172 may be spring-loaded to the open position. During maintenance and servicing, the operator moves the door 172 to a locked position in front of the exit aperture 170 and then raises the playfield assembly 23 to a desired height for maintenance and servicing. After performing the required maintenance and servicing, the door 172 is released from the locked position such that it springs back to its open position and thereby allows the rolling balls 26 to be pushed out of the ball trough 166 by the solenoid mechanism 168. Also, while the door 172 has been described as being located adjacent to the exit aperture 170, it may also be positioned within the ball trough 166 adjacent to the exit aperture 170.

The ball block 172 may be applied to any type of pinball machine, including but not limited to the pinball machine 20 disclosed herein, which allows the playfield assembly to be tilted upwardly for maintenance and servicing.

Referring back to FIG. 2, another advantageous feature of the present invention is that the driver electronics board 98 in the cabinet 22 has on it a plurality of fuses for protecting its main and secondary power supplies. Adjacent to each of these fuses is a light-emitting diode (LED) powered by the electrical energy passing through the adjacent fuse. Therefore, the LED remains illuminated while the corresponding fuse is operable; however, when the fuse is blown, the adjacent LED turns off.

Although the placement of LEDs adjacent to fuses has been done previously, the pinball machine 20 has the unique feature of utilizing its controller 70 (see FIG. 12) to sample the voltage drop across the LED adjacent to each fuse on the driver electronics board 98. In doing so, the controller can determine whether each of the fuses is operable or has blown. If the fuse has blown, the controller can cause the video display 50 during a diagnostic session to show exactly which fuse has blown. The condition of a fuse can be represented by a color on the video display 50. Operable fuses can be shown in a first color, while blown fuses can be shown in a second color. When a fuse goes out, the fuse changes from the first color to the second color.

Additionally, the controller can cause the video display 50 to show information about a plurality of fuses on one screen. The information may, for example, include the condition of the fuse and the type of fuse (e.g., amps and voltage). Thus, an operator performing the diagnostics on the pinball machine can easily observe that a particular fuse has blown and confirm this by looking at the driver electronics board 98 in the cabinet 22 to see that in fact the LED associated with that fuse is not illuminated. The operator can use the electronics board 98 to determine what type of fuse has blown and thereby replace it with the same type of fuse.

Figure 29:
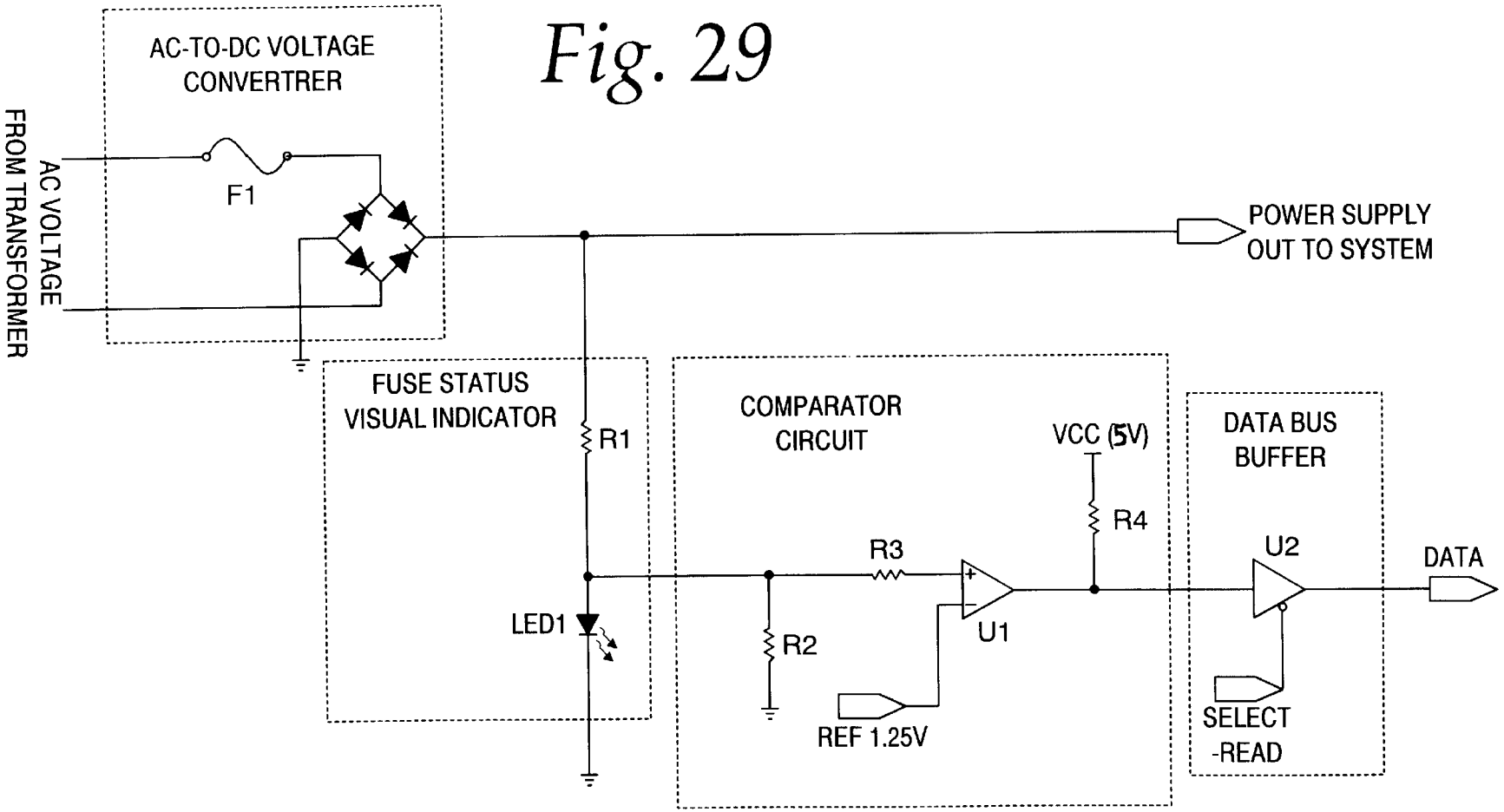
FIG. 29 is a schematic diagram of a fuse detection circuit for indicating whether a fuse is operable or blown.

The controller samples the DATA output of a fuse detection circuit depicted in FIG. 29 to determine whether a fuse F1 is operable or blown. The fuse detection circuit uses the voltage that is developed across a light-emitting diode LED1 associated with the fuse to make this determination. LED1 provides a visual indication of the condition of the fuse F1 in addition to that which is displayed on the video display 50 (see FIG. 2). If the fuse F1 is operable, then LED1 is illuminated and the voltage across LED1 is approximately 1.4 volts; if, however, the fuse F1 has blown, then LED1 is not illuminated and the voltage across LED1 is zero (0) volts. Thus, by measuring the voltage across LED1, the condition of the fuse F1 can be determined. The fuse detection circuit includes a comparator circuit to measure the voltage across LED1 and a data bus buffer U2 to selectively output the measured voltage.

The fuse detection circuit in FIG. 29 is designed to read the voltage across LED1 because the known and given voltage values across an LED for its two conditions are 1.4 volts and zero (0) volts. Resistor R1 limits a total current through LED1 where the value of the resistor R1 is determined mathematically according to the power supply voltage of the power supply that is to be monitored by the fuse F1. This makes it possible to have the same circuit repeated multiple times having one for each power supply and associated fuse. Resistor R2 provides proper biasing of zero (0) volts when no current is passing through LED1. Resistor R3 protects the input of comparator U1 from any possible excessive voltages or currents. The comparator U1 measures the voltage across LED1 against a reference of approximately 1.25 volts and determines whether the voltage across LED1 is above or below that reference. Since the output of the comparator U1 is of an open-collector type, resistor R4 is needed as a pull up to five (5) volts in order to translate the voltage to a level that enables the data bus buffer U2 to function properly. The buffer U2 allows the controller to selectively monitor the condition of LED1 and, therefore, the condition of the fuse F1. The controller can cause the video display 50 (see FIG. 2) to show the condition of the fuse F1 during a diagnostic session.

In addition to fuse detection circuitry, the driver electronics board 98 (see FIG. 2) has lamp detection circuitry for indicating whether lamps mounted to the playfield 24 are operable, suffer from an open circuit, or suffer from a short circuit. An open circuit would generally result from the lamp itself being burned out or a broken wire leading to the lamp. A shorted lamp would generally involve a short circuit in the light socket of the lamp. If a lamp suffers from an open or short circuit, the controller can cause the video display 50 during a diagnostic session to show exactly which lamp suffers from the open or short circuit. The condition of a lamp can be represented by a color on the video display 50. Operable lamps can be shown in a first color, lamps suffering from open circuits can be shown in a second color, and lamps suffering from short circuits can be shown in a third color. When a lamp becomes inoperable, the lamp changes from the first color to either the second or third color depending upon whether the lamp has an open or short circuit. The controller can cause the video display 50 to show information about a plurality of lamps on one screen. Thus, an operator performing the diagnostics on the pinball machine can easily observe that a particular lamp has an open or short circuit.

Figure 30:
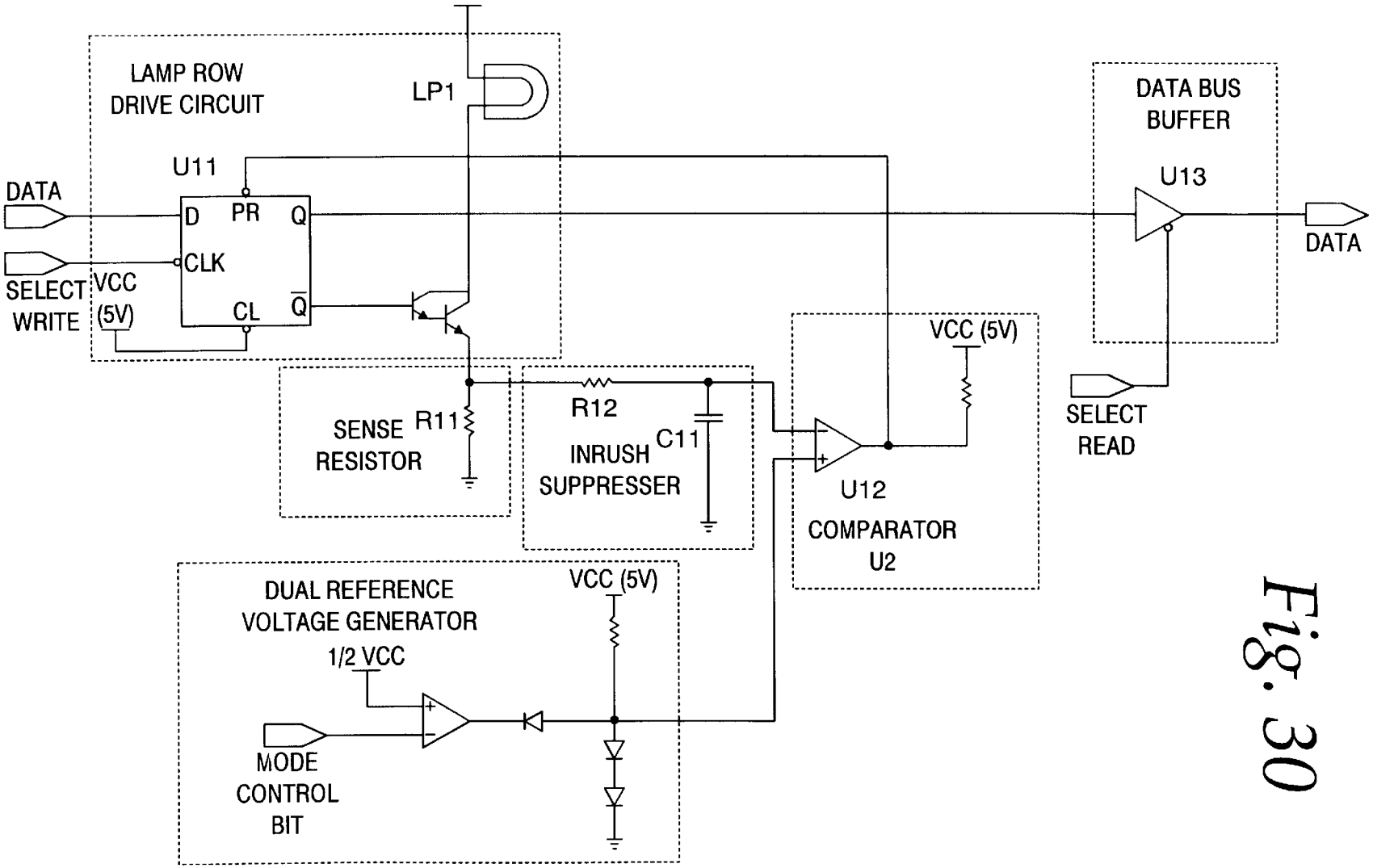
FIG. 30 is a schematic diagram of a lamp detection circuit for indicating whether a lamp is operable, burned out, or shorted.

The controller samples the DATA output of a lamp detection circuit depicted in FIG. 30 to determine whether a lamp LP1 is operable or suffers from an open or short circuit. The lamp detection circuit has two modes of operation, one for determining whether the lamp LP1 suffers from an open circuit and another for determining whether the lamp LP1 suffers from a short circuit. The mode of operation is selected by setting a MODE CONTROL BIT. When this bit is high (1), the lamp detection circuit works in the open circuit detection mode; when the bit is low (0), the circuit works in the short circuit detection mode. The lamp current is passed through resistor R11 in response to a row drive circuit being activated to turn on the lamp LP1. By measuring the voltage that is developed across the resistor R11 due to the current flow therethrough, the status of the lamp LP1 can be determined. The voltage across the resistor R11 is measured and compared to a reference voltage provided by a dual reference voltage generator circuit. If this measured voltage is greater than the reference voltage, a comparator U12 will "set" a lamp row data register U11 so as to turn off the lamp LP1. By reading a data bus buffer U13, the controller can then read the status of the lamp row data register U11 to determine if the register U11 was forced by the comparator U12 to change to an off state.

Depending upon the reference voltage selected, the condition of the lamp be known as being either a short or open. The dual reference voltage generator provides a voltage reference of about 0.4 to 0.6 volts for use in the burned-out detection mode and a voltage reference of 1.4 volts for use in the lamp-shorted detection mode.

Lamps have a very high inrush current because the cold resistance of the filament is relatively low compared with the hot/illuminated filament resistance. Therefore, an inrush suppressor with a resistor R12 and capacitor C11 are employed to suppress or filter out this momentary excessive current. The inrush suppressor prevents false voltages that could cause false lamp conditions from being measured and compared by the comparator U12.

Heretofore, lamp detection circuits have only measured for lamp shorts (shorted lamps), not opens (e.g., burned-out lamps), and have not included a data bus buffer akin to buffer U13 in FIG. 30 for reading the status of the lamp row data register. The voltage reference circuit in prior lamp detection circuits only employed a single reference voltage of 1.4 volts. Prior lamp detection circuits were used to protect driver board transistors from excessive currents due to lamp shorts. This protection is still one purpose of the lamp detection circuit in FIG. 30, but the circuit in FIG. 30 provides the enhanced ability to monitor lamps for both opens and shorts by virtue of the dual reference voltage generator and the data bus buffer U13. Opens are identified by lowering the voltage reference to a value that allows the protection circuitry to be active with very little current, thereby allowing the system to determine if a lamp is present or not and, therefore, identify a lamp suffering from an open circuit.

The output of the fuse detection circuit in FIG. 29 is indicative of the condition of the fuse being monitored by that circuit. Likewise, the output of the lamp detection circuit in FIG. 30 is indicative of the condition of the lamp being monitored by that circuit. The controller is operated to selectively read the outputs of the fuse and lamp detection circuit and to cause the video display 50 to visually represent these outputs in graphics or text, preferably during a diagnostic session. The controller also has the ability to send the outputs of the fuse and lamp detection circuits to other types of diagnostic video display devices, such as personal computers and dot-matrix displays. For example, the controller could be connected to a portable computer carried by a service operator performing diagnostics on the pinball machine.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A playfield assembly to be mounted within a cabinet of a pinball machine and having opposing distal and proximal ends separated by a length L, comprising:

a playfield including a substantially planar top surface for receiving a rolling ball and a lower surface below said top surface;

skid rails mounted below said lower surface, said skid rails extending along a portion of said length L; and a slide stop projecting away from said lower surface further than said skid rails, said slide stop for engaging a portion of said cabinet during removal or installation of said playfield.

2. The playfield of claim 1, wherein said slide stop is substantially perpendicular to said skid rails.

3. The playfield of claim 1, wherein said slide stop is located adjacent to said distal end.

4. The playfield of claim 1, wherein said slide stop is located adjacent to said proximal end.

5. The playfield of claim 4, further including a second slide stop projecting away from said lower surface and being located adjacent to said distal end.

6. The playfield of claim 1, wherein said slide stop is for engaging a front molding of said cabinet.

7. The playfield of claim 1, wherein said skid rails extend substantially along said length L, said slide stop being located adjacent to one of said proximal and distal ends.

8. The playfield of claim 1, wherein said slide stop is attached to said skid rails.

9. The playfield of claim 8, further including a second slide stop attached to said skid rails, said slide stop and said second slide stop being at opposite ends of said skid rails.

10. A method of installing a playfield assembly into a cabinet of a pinball machine, said cabinet including a front end where player inputs are received and a back end where a back box displaying game information is mounted, said playfield assembly having a distal end to be located adjacent to said back end and a proximal end to be located adjacent to said front end, said playfield assembly including a playfield, skid rails mounted below a lower surface of said playfield, and a slide stop projecting further away from said lower surface than said skid rails, said slide stop being nearer to said proximal end than to said distal end, said method comprising:

engaging said front end of said cabinet with said skid rails of said playfield assembly;

moving said playfield assembly into said cabinet as said skid rails move along said front end;

engaging said slide stop with said front end to stop the movement of said playfield assembly into said cabinet;

moving said slide stop over said front end of said cabinet; and advancing said playfield assembly to a final location within said cabinet.

11. The method of claim 10, wherein said moving said slide stop over said front end of said cabinet includes lifting said proximal end of said playfield assembly.

12. The method of claim 10, wherein said skid rails and said slide stop are made of metal.

13. The method of claim 10, wherein said proximal and distal ends of said playfield assembly are separated by a length L, said skid rails extending substantially along said length L, said slide stop being located adjacent to said proximal end.

14. The method of claim 10, wherein said moving said playfield assembly into said cabinet is accomplished while said distal end is within said cabinet and said proximal end is outside of said cabinet.

15. The method of claim 14, wherein said moving said playfield assembly into said cabinet is accomplished while said distal end is above said proximal end.

16. The method of claim 10, wherein said slide stop is attached to said slide rails.

17. A method of removing a playfield assembly from a cabinet of a pinball machine, said cabinet including a front end where player inputs are received and a back end where a back box displaying game information is mounted, said playfield assembly having a distal end to be located adjacent to said back end and a proximal end to be located adjacent to said front end, said playfield assembly including a playfield, skid rails mounted below a lower surface of said playfield, and a slide stop projecting further away from said lower surface than said skid rails, said slide stop being nearer to said distal end than to said proximal end, said method comprising:

lifting said proximal end of said playfield assembly;

engaging said front end of said cabinet with said skid rails of said playfield assembly;

moving said proximal end of said playfield assembly away from said cabinet as said skid rails move along said front end of said cabinet;

engaging said slide stop with said front end to stop the movement of said playfield assembly from said cabinet; and moving said playfield assembly to a final location outside of said cabinet.

18. The method of claim 17, wherein said moving said playfield assembly to a final location outside of said cabinet includes lowering said proximal end of said playfield assembly to a ground surface, thereby raising said distal end of said playfield assembly and disengaging said slide stop from said front end of said cabinet.

19. The method of claim 17, wherein said skid rails and said slide stop are made of metal.

20. The method of claim 17, wherein said proximal and distal ends of said playfield assembly are separated by a length L, said skid rails extending substantially along said length L, said slide stop being located adjacent to said proximal end.

21. The method of claim 17, wherein said slide stop is attached to said slide rails.

22. The method of claim 17, wherein said playfield assembly includes a second slide stop being nearer to said proximal end than to said distal end, said method further including engaging said second slide stop with said front end to ensure said playfield does not slide back into said cabinet.

23. A playfield assembly to be mounted within a cabinet of a pinball machine, comprising:

a playfield having opposing distal and proximal ends separated by a length L;

input/output elements mounted to said playfield and having portions extending away from a lower side of said playfield by a maximum distance D; and skid rails mounted on said lower side of said playfield, said skid rails extending along substantially the entire length L and extending to a location immediately adjacent to said distal end of said playfield, said skid rails being spaced from said lower side of said playfield by a distance greater than said distance D.

24. A playfield assembly to be mounted within a cabinet of a pinball machine, comprising:

a playfield having opposing distal and proximal ends separated by a length L;

input/output elements mounted to said playfield and having portions extending away from a lower side of said playfield by a maximum distance D; and skid rails mounted on said lower side of said playfield, said skid rails extending entirely along said length L, said skid rails being spaced from said lower side of said playfield by a distance greater than said distance D.

25. A playfield assembly to be mounted within a cabinet of a pinball machine, comprising:

a playfield having opposing distal and proximal ends separated by a length L;

input/output elements mounted to said playfield and having portions extending away from a lower side of said playfield by a maximum distance D; and skid rails mounted on said lower side of said playfield, said skid rails extending substantially along said length L, said skid rails being spaced from said lower side of said playfield by a distance greater than said distance D, said skid rails including end stops adjacent to said proximal end for engaging a front end of said cabinet during assembly or installation.

* * * * *